US006924966B2

(12) United States Patent
Prophet

(10) Patent No.: US 6,924,966 B2
(45) Date of Patent: Aug. 2, 2005

(54) SPRING LOADED BI-STABLE MEMS SWITCH

(75) Inventor: Eric M. Prophet, Santa Barbara, CA (US)

(73) Assignee: Superconductor Technologies, Inc., Santa Barbara, CA (US)

( * ) Notice: Subject to any disclaimer, the term of this patent is extended or adjusted under 35 U.S.C. 154(b) by 530 days.

(21) Appl. No.: 10/159,977

(22) Filed: May 29, 2002

(65) Prior Publication Data

US 2003/0223174 A1 Dec. 4, 2003

(51) Int. Cl.[7] ..... H01H 47/00

(52) U.S. Cl. ..... 361/207; 361/206; 361/211; 361/233

(58) Field of Search ..... 361/206, 207, 361/160, 170, 152, 233, 212, 211, 115

(56) References Cited

U.S. PATENT DOCUMENTS

| | | | |
|---|---|---|---|
| 4,492,922 | A | 1/1985 | Ohkubo |
| 4,565,972 | A | 1/1986 | Kaegebein |
| 5,020,138 | A | 5/1991 | Yasuda et al. |
| 5,120,705 | A | 6/1992 | Davidson et al. |
| 5,418,490 | A | 5/1995 | Kaegebein |
| 5,604,925 | A | 2/1997 | O'Malley et al. |
| 5,867,302 | A | 2/1999 | Fleming |
| 5,999,851 | A | 12/1999 | White |
| 6,016,092 | A | 1/2000 | Qiu et al. |
| 6,069,540 | A | 5/2000 | Berenz et al. |

(Continued)

FOREIGN PATENT DOCUMENTS

| | | |
|---|---|---|
| WO | WO 91/19348 A1 | 12/1991 |
| WO | WO 91/19349 A1 | 12/1991 |
| WO | WO 01/84211 A2 | 11/2001 |

OTHER PUBLICATIONS

Brenner, M.P. et al., "Optimum Design of a MEMS Switch", Modelling and Stimulation of Microsystems 2002, pp 214–217.

Bautista, et al., "Superconducting NBTI & PB(CU) Bandpass Filters", IEEE Transactions On Magnetics, MAG–21, Mar. 2, 1985, 640–643.

Booz–Allen, "HTSC Dual Use Applications Survey–Progress Report", Advanced Research Agency, Washington D.C., Jan. 23, 1995.

Decibel, Quandra™, The Fail Safe Tower Top Amp System. An Industry Firstl, Quantdra™ Now Your System Can Be Fail Safe With The Ultimate Tower Top Systeml, Decibel Products, 1992.

(Continued)

*Primary Examiner*—Stephen W. Jackson
(74) *Attorney, Agent, or Firm*—O'Melveny & Myers LLP

(57) ABSTRACT

A MEMS switch assembly comprising a substrate and a resilient switching member is provided. The resilient switching member comprises a transverse torsion member having a flexible portion, and a leaf spring and cantilever that extend from the flexible portion of the torsion member. The switching assembly further comprises a first anchoring member mounting the torsion member to the stable structure, and a second anchoring member mounting the leaf spring to the stable structure. In this manner, the leaf spring has a flexible portion between the first and second anchors that can be alternately flexed in opposing directions to deflect the cantilever end in the respective opposing directions. The leaf spring can exhibit a first stable geometry (e.g., a convex geometry) when flexed in one of the opposite directions, and a second stable geometry (e.g., a concave geometry) when flexed in another of the opposite directions. Thus, the switch can be switched between two stable states using a momentary force and can maintain these two stable states without further expenditure of energy.

55 Claims, 20 Drawing Sheets

U.S. PATENT DOCUMENTS

| | | | | |
|---|---|---|---|---|
| 6,104,934 | A | | 8/2000 | Patton et al. |
| 6,124,650 | A | | 9/2000 | Bishop et al. |
| 6,168,395 | B1 | | 1/2001 | Quenzer et al. |
| 6,205,340 | B1 | | 3/2001 | Yandrofski et al. |
| 6,212,404 | B1 | | 4/2001 | Herstig |
| 6,236,300 | B1 | | 5/2001 | Minners |
| 6,239,685 | B1 | | 5/2001 | Albrecht et al. |
| 6,263,215 | B1 | | 7/2001 | Patton et al. |
| 6,294,847 | B1 | | 9/2001 | De Los Santos |
| 6,303,885 | B1 | | 10/2001 | Hichwa et al. |
| 6,307,169 | B1 | | 10/2001 | Sun et al. |
| 6,384,707 | B2 | | 5/2002 | Minners |
| 6,426,687 | B1 | * | 7/2002 | Osborn ..... 333/262 |
| 6,496,612 | B1 | | 12/2002 | Ruan et al. |
| 6,622,028 | B1 | | 9/2003 | Abdelmonem |
| 6,720,851 | B2 | * | 4/2004 | Hallbjorner et al. ..... 335/78 |
| 2001/0010488 | A1 | | 8/2001 | Minners |
| 2002/0050880 | A1 | | 5/2002 | Ruan et al. |
| 2002/0119805 | A1 | | 8/2002 | Smith |
| 2002/0121951 | A1 | | 9/2002 | Shen et al. |
| 2002/0149456 | A1 | | 10/2002 | Krimmer et al. |
| 2002/0151332 | A1 | | 10/2002 | Eddy |
| 2002/0173343 | A1 | | 11/2002 | Narahashi et al. |
| 2002/0196110 | A1 | | 12/2002 | Vailkus et al. |
| 2003/0025580 | A1 | | 2/2003 | Wheeler et al. |
| 2003/0029705 | A1 | | 2/2003 | Qiu et al. |
| 2003/0156006 | A1 | | 8/2003 | Hanke et al. |

OTHER PUBLICATIONS

Meder Electronics, Confidential Preliminary Datasheet, Part No. CRF05–1A, SPST RF Reed Relay For 50Ω Impedance, MQC–1029, Nov. 2000, 1–3.

Prauter, et al., "Insertion Loss & Noise Temperature Contribution Of High Temperature Superconducting Bandpass Filters Centered At 2.3 & 8.45 GHz", TDA Progress Report 42–114, Aug. 19993, 61–67.

Robertson, Two Applications Of HTS Technology On An Airborne Platform, High Tc Microwave Superconductors & Applications, SPIE—The Intl Society for Optical Engineering, 2156, Jan. 1994, 13–20.

SCT, "Reach™. A High Performance Wireless Base Station Front End", Superconducting Core Technologies, Golden, Colorado, 1995, 1–A4–3.

Soares, et al., "Applications Of High Temperature Superconducting Filters & Cryo–electronics For Satellite Communications", IEEE Transactions On Microwave Theory & Techniques, 48, Jul. 7, 2000, 1190–1198.

TX RX Systems, 800 MHz Towr Mounted Receiver Multicoupler Model 421–86–01–(XX), Angola, New York.

* cited by examiner

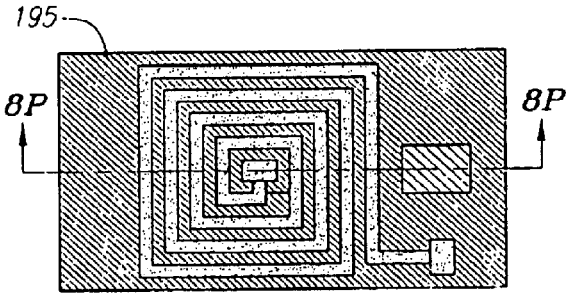
FIG. 7P
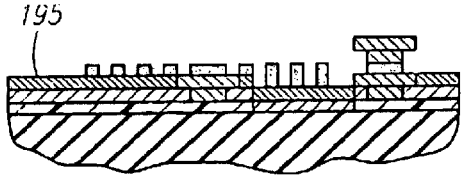
FIG. 8P
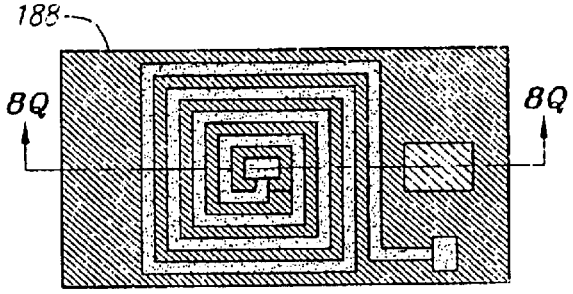
FIG. 7Q
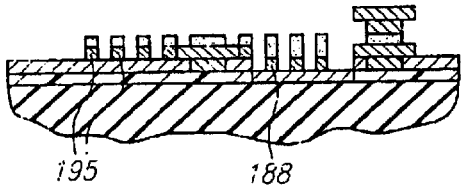
FIG. 8Q
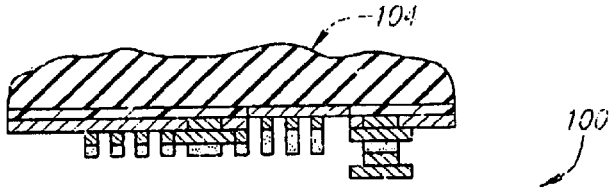
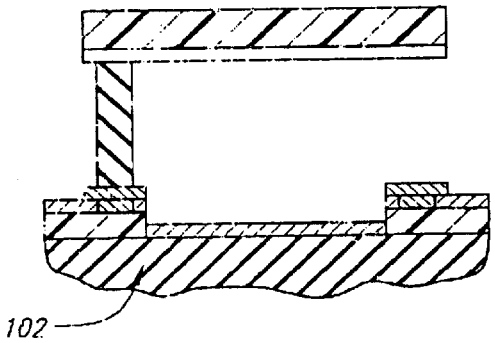
FIG. 9

SPRING LOADED BI-STABLE MEMS SWITCH

The U.S. Government may have a paid-up license in this invention and the right in limited circumstances to require the patent owner to license others on reasonable terms as provided for by the terms of contract no. MDA972-00-C-0010 awarded by DARPA.

FIELD OF THE INVENTION

The present inventions generally relate switching devices, and more specifically, to bi-stable switches.

BACKGROUND OF THE INVENTION

Micro-Electro-Mechanical System (MEMS) devices find applications in a variety of fields, such as communications, sensing, optics, micro-fluidics, and measurements of material properties. In the field of communications, MEMS Radio Frequency (RF) switches offer several advantages over solid state switches, including a more linear response and a higher quality (Q) factor. Typical MEMS switches require the application of a constant electrostatic or magnetic force in order to maintain the switching assembly in at least one of the desired positions. This results in an inefficient use of power and can be disadvantageous in applications where the conservation of power is desirable, e.g., in mobile wireless phones.

Thus, there remains a need for a reliable bi-stable MEMS RF switch that has the ability to conserve power in any state that it is currently in.

SUMMARY OF THE INVENTION

The present inventions are directed to a switch assembly that comprises a stable structure, such as, e.g., a substrate, and a resilient switching member mounted to the stable structure. The resilient switching member comprises a transverse torsion member having a flexible portion, and a leaf spring(s) and cantilever that extend from the flexible portion of the torsion member. The switching assembly further comprises a first anchoring member mounting the torsion member to the stable structure, and a second anchoring member mounting the leaf spring to the stable structure. In this manner, the leaf spring has a flexible portion between the first and second anchors that can be alternately flexed in opposing directions to deflect the cantilever end in the respective opposing directions. In the preferred embodiment, the switch assembly is a micro-electro-mechanical system (MEMS) switch. The present inventions, however, are not limited to MEMS switches, and contemplate other types of mechanical switches as well.

By way of non-limiting example, the leaf spring can exhibit a first stable geometry when flexed in one of the opposite directions, and a second stable geometry when flexed in another of the opposite directions. In this case, the leaf spring can have a stress gradient that maintains the leaf spring in the stable geometries. The geometries can be any shape, but in the preferred embodiments, concave and convex geometries, which correspond to the first bending modes of the leaf springs, and advantageously provide good responsiveness to the switching member, are used. Thus, the switch can be switched between two stable states using a momentary force and can maintain these two stable states without further expenditure of energy. In the preferred embodiment, the free end of the cantilever deflects a greater distance than that of the maximum displacement of the leaf spring, e.g., more than twice as great. Thus, in this case, the unique geometry of the switching member acts as a mechanical amplifier and allows for a large travel distance of the cantilevered end, while maintaining reasonable actuation dimensions.

In the preferred embodiment, the switching member is formed of a planar membrane, which advantageously provides for a more easily manufacturable and responsive structure. The switching member may further comprise another leaf spring that extends from the flexible portion of the torsion member, so that the first and second leaf springs straddle a center cantilever. In this manner, the second leaf spring provides more responsiveness to the switching member. To minimize electrical interference that may otherwise be caused by the leaf spring (if electrically conductive), the cantilever extends from the flexible portion of the torsion member a greater distance than does the leaf spring, so that any electrical terminal that the free end of the cantilever comes in contact with is spaced a sufficient distance from the electrically active spring.

The switching assembly can be designed to achieve any one of a variety of switching methodologies. For example, the switching assembly can be arranged as a single pole double throw (SPDT) switch, in which case, the switching assembly comprises a common electrical terminal that is permanently electrically coupled to the cantilever (which is electrically conductive), a first electrical terminal that is electrically coupled to the cantilever only when the cantilever is deflected in one of the opposite directions, and a second electrical terminal that is electrically coupled to the cantilever only when the cantilever is deflected in another of the opposite directions. In this case, the first anchor can be electrically coupled and can be mounted to the common terminal to provide an electrical pathway to the cantilever. In this manner, the common terminal is electrically coupled to one of the selected first and second terminals via the anchor and cantilever.

As another example, the switching assembly can be arranged as a single pole single throw (SPST) switch. In this case, the switching assembly may comprise a first electrical terminal that is permanently electrically coupled to the cantilever (which is electrically conductive), and a second electrical terminal that is electrically coupled to the cantilever only when the cantilever is deflected in one of the opposite directions. In this case, the first anchor can be electrically coupled and can be mounted to the first terminal to provide an electrical pathway to the cantilever. In this manner, the first terminal is selectively electrically coupled to the second terminal. Using the SPST switching methodology, the switching assembly may alternatively comprise first and second electrical terminals that are both electrically coupled to the cantilever only when the cantilever is deflected in one of the opposite directions. In this case, the cantilever may comprise a shorting bar that shorts the first and second electrical terminals when the cantilever is deflected in the one opposite direction. In this case, the switching member, with the exception of the shorting bar, can be composed of an insulating material to minimize electrical interference.

In the preferred embodiment, the switching assembly comprises an actuator that is operatively coupled to the leaf spring to alternately flex the leaf spring in the opposing first and second directions. By way of non-limiting example, the leaf spring may be actuated magnetically, electrostatically, piezoelectrically, or thermally. In the preferred embodiment, a magnetic actuator is used because of the relatively large displacements involved. For example, the magnetic actuator may comprise a magnetic field coil and one or more ferrous elements. The magnetic field coil may be affixed to the leaf spring, in which case, the one or more ferrous elements may be placed a distance from the magnetic field coil, such that the leaf spring is flexed towards the one or more ferrous elements when electrical current with a first polarity flows through the magnetic field coil, and is flexed away from the one or more ferrous elements when electrical current with a second polarity flows through the magnetic field coil. Or the one or more ferrous elements may be affixed to the leaf spring, in which case, the magnetic field coil may be placed a distance from the magnetic field coil, such that the leaf spring is flexed towards the one or more ferrous elements when electrical current with a first polarity flows through the magnetic field coil, and is flexed away from the one or more ferrous elements when electrical current with a second polarity flows through the magnetic field coil.

BRIEF DESCRIPTION OF THE DRAWINGS

The drawings illustrate the design and utility of preferred embodiments of the present invention, in which similar elements are referred to by common reference numerals. In order to better appreciate how the above-recited and other advantages and objects of the present inventions are obtained, a more particular description of the present inventions briefly described above will be rendered by reference to specific embodiments thereof, which are illustrated in the accompanying drawings. Understanding that these drawings depict only typical embodiments of the invention and are not therefore to be considered limiting of its scope, the invention will be described and explained with additional specificity and detail through the use of the accompanying drawings in which:

FIG. 9 is a side view of the fully assembled switching assembly of FIG. 1 after the top chip is mounted to the bottom chip;

DETAILED DESCRIPTION OF THE PREFERRED EMBODIMENTS

Figure 1:
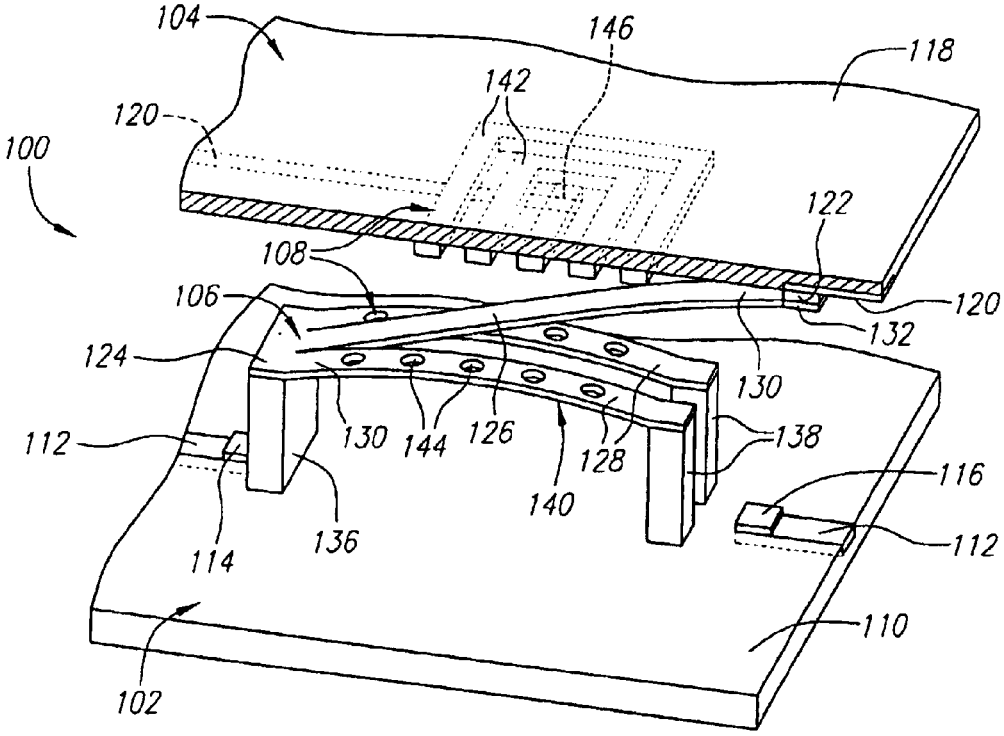
FIG. 1 is a partial cutaway perspective view of a single pole dual throw MEMS RF switching assembly constructed in accordance with one preferred embodiment of the present inventions, wherein the switching assembly is particularly shown in an up-state.
Figure 2:
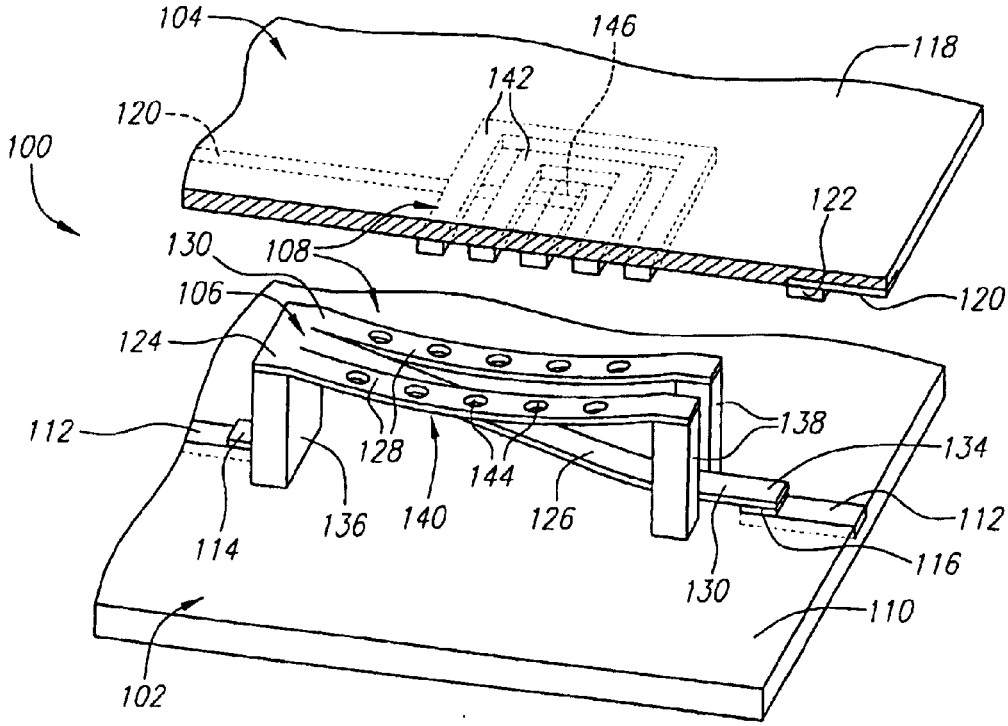
FIG. 2 is a partial cutaway perspective of the switching assembly of FIG. 1, wherein the switching assembly is particularly shown in a down-state.

Referring generally to FIGS. 1 and 2, a spring actuated bi-stable micro-electro-mechanical system (MEMS) radio frequency (RF) switching assembly 100 constructed in accordance with one preferred embodiment of the present inventions will now be described. The switching assembly 100 is bi-stable in that it remains "locked" in one stable state until an applied external force causes it transfer to another stable state, where it is again locked until acted on by another external force. Thus, the switching assembly 100 requires no external force to remain in any of its stable states or positions. It only requires a momentary force to switch from on stable position to the other stable position.

The switching assembly 100 can be characterized as a single pole double throw (SPDT) switch in that it is configured as a mechanically latching two-chip switch capable of switching a common RF signal between electrically isolated circuits disposed on the respective chips. In this regard, the switching assembly 100 generally comprises a bottom chip 102, a top chip 104, a resilient planar switching member 106 anchored to the bottom chip 102, and an actuator 108 that is operatively coupled to the switching member 106 to place the switching assembly 100 into an "up" state (FIG. 1) that couples a common signal to the circuitry of the top chip 104, and a "down" state (FIG. 2) that couples the common signal to the circuitry of the bottom chip 102. The bottom and top chips 102 are mounted to each other via standoffs (not shown).

The bottom chip 102 comprises a substrate 110, which in the illustrated embodiment, is composed of a suitable material, such as Aluminum Oxide ($Al_2O_3$). Other substrate material, such as silicon, ceramic, polymer, glass, or semiconductor material such as gallium arsenide, can be used. The bottom chip 102 further comprises electrical circuitry in the form of a coplanar waveguide (CPW) 112, which is disposed on the substrate 110 to provide the bottom chip 102 with RF power and signal conducting capability. The CPW 112 is composed of a suitably conductive material with good RF properties, such as gold or silver. Alternatively, the CPW 112 may be made of a thin-film High Temperature Superconductor (HTS) material on, e.g., a MgO substrate. Thin-film HTS materials are now routinely formed and are commercially available. See, e.g., U.S. Pat. Nos. 5,476,836, 5,508,255, 5,843,870, and 5,883,050. Also see, e.g., B. Roas, L. Schultz, and G. Endres, "Epitaxial growth of YBa2Cu3O7-x thin films by a laser evaporation process"

Appl. Phys. Lett. 53, 1557 (1988) and H. Maeda, Y. Tanaka, M. Fukotomi, and T. Asano, "A New High-Tc Oxide Superconductor without a Rare Earth Element" Jpn. J. Appl. Phys. 27, L209 (1988). The bottom chip 102 further comprises a common RF input terminal 114 from which the RF signal is switched between the bottom and top chips 102 and 104, and a bottom RF output terminal 116 that is placed into electrical conduction with the common RF input terminal 114 when the switching assembly 100 is placed in the down state (see FIG. 2).

The top chip 104 comprises a substrate 118, which like the bottom substrate 110, is composed of a suitable material, such as Aluminum Oxide. The top chip 104 further comprises electrical circuitry in the form of a CPW 120, which is disposed on the substrate 118 to provide the top chip 104 with RF power and signal conducting capability. The CPW 120 is composed of a suitable conductive material, such as gold or silver, or alternatively a HTS material. The top chip 104 further comprises a top RF output terminal 122 that is placed into electrical conduction with the common input terminal 114 when the switching assembly 100 is placed in the up state (see FIG. 1).

Figure 3:
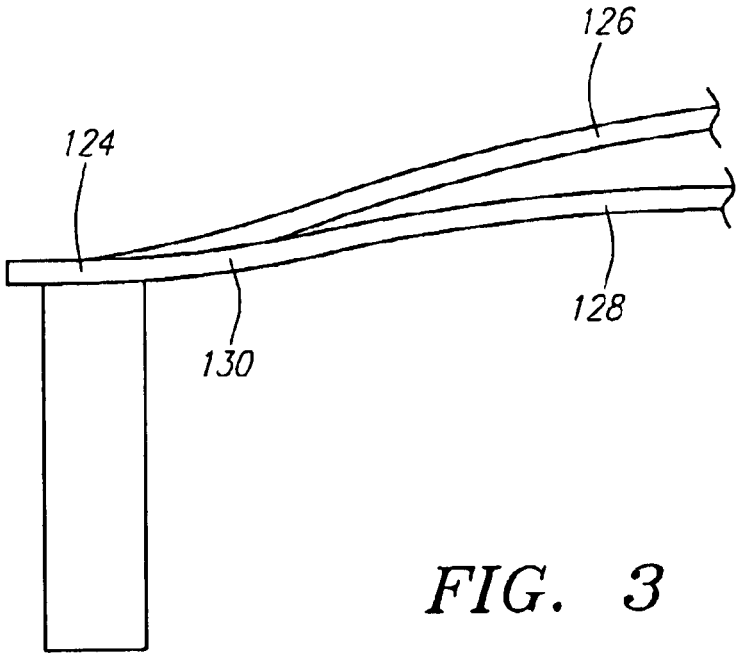
FIG. 3 is a close-up view of a switching member used in the switching assembly of FIG. 1 when the switching assembly is in the up-state.
Figure 4:
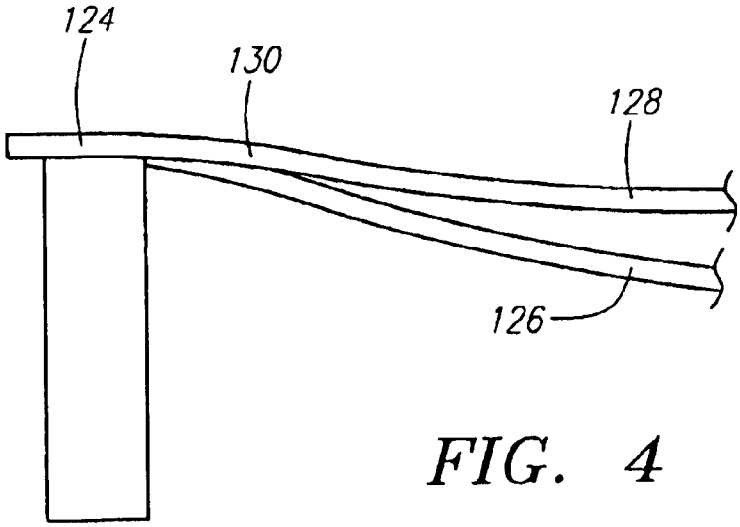
FIG. 4 is a close-up view of a switching member used in the switching assembly of FIG. 1 when the switching assembly is in the down-state.

The switching member 106 comprises a transverse torsion member 124, a center cantilever 126 extending from the end of the transverse torsion member 124, and a pair of leaf springs 128 extending from the end of the transverse torsion member 124 and straddling the cantilever 126. The center cantilever comprises a free end 130, which includes a pair of opposing contacts 132 and 134 that alternately couple to the bottom and top terminals 116 and 122, as will be discussed in further detail below. The switching member 106 is composed of a metal characterized by high electrical conductivity, low loss, ease of deposition, and excellent flexibility. Suitable metals for the metal layer include, but are not limited to, gold and silver. Thus, the center cantilever 126 acts as a reed that can be positioned in the "up-state" or "down-state" by flexing the springs. 128 either up or down respectively. Specifically, when the springs 128 are flexed up, a flexing portion 130 of the torsion member 124 at the base of the cantilever 126 tilts upward, which in turn, rotates the cantilever 126 upward (best shown in FIG. 3). When the springs 128 are flexed down, the flexing portion 130 of the torsion member 124 at the base of the cantilever 126 tilts downward, which in turn, rotates the cantilever 126 downward (best shown in FIG. 4).

The springs 128 lock the cantilever 126 into place once the transition has been made. Specifically, when viewed from the top chip 104, the springs 128 are capable of exhibiting a stable convex geometry (FIG. 1) when flexed upward, and exhibiting a stable concave geometry (FIG. 2) when flexed downward. Thus, once the springs 128 are flexed up to assume the convex geometry, the cantilever 126 switches from the down-state to the up-state, and is maintained in the up-state until the springs 128 are flexed down. Likewise, once the springs 128 are flexed down to assume the concave geometry, the cantilever 126 switches from the up-state to the down-state, and is maintained in the down-state until the springs 128 are flexed up.

As illustrated, the free end 130 of the cantilever 126 is advantageously deflected a greater vertical distance than are the springs 128. This effect can be accomplished by introducing an intrinsic stress gradient within springs 128 to cause them to exhibit a greater curvature than that exhibited by the cantilever 126. As result, the greater curvature of the springs 128 will prevent the ends of the springs 128 from achieving a large vertical deflection, while the lesser curvature of the cantilever 126 will allow the free end 130 of the cantilever 126 to achieve a large vertical deflection. Because the cantilever 126 should remain relatively flat (little or no residual stress), the stress gradient in the leaf springs 128 should be introduced selectively. As will be discussed in further detail below, the stress gradient can be introduced into the springs 128 by layering the springs 128, e.g., with two metals with different coefficients of thermal expansions (CTE's), or by using a single metal with an intrinsic stress gradient (e.g., soft gold and hard gold).

Preliminary calculations show that the vertical deflection of the cantilever 126 is more than twice (about six times) the vertical deflection of the springs 128. For example, given lengths for the cantilever 126 and springs 128 of 0.85 mm and 0.60 mm, an estimated crude deflection of the cantilever 126 in one direction was calculated to be 0.085 mm, whereas the estimated crude deflection of the springs 128 in one direction was calculated to only be 0.014 mm. Thus, the unique geometry of the switching member 106 acts as a mechanical amplifier and allows for a large travel distance of the cantilever end 130, while maintaining reasonable actuation dimensions.

To provide a stable platform, the switching member 106 is mounted to the bottom chip 102 via three anchors. Specifically, the torsion member 124 of the switching member 106 is mounted to a common anchor 136, which is in turn mounted to, and is in electrical contact with, the common input terminal 114 of the bottom chip 102. In this manner, the common anchor 136 acts as an electrical conduit between the common input terminal 114 and the cantilever 126. The ends of the springs 128 opposite the torsion member 124 of the switching member 106 are mounted to two respective anchors 138, which are in turn mounted to the bottom chip 102. Thus, the springs 128 have flexible portions 140 that extend between the common anchor 136 and the spring anchors 138. Unlike the common anchor 136, the spring anchors 138 merely function as support structures, and not as electrical conduits, and are thus not in direct electrical communication with the CPW 112 of the bottom chip 102.

Thus, it can be appreciated that when the switching assembly 100 is in the up-state, a closed circuit is created between the common input terminal 114 and the top output terminal 122. Specifically, the contact point 134 of the center cantilever 126 makes contact with the top output terminal 122 on the top chip 104, such that an RF signal at the common input terminal 114 of the bottom chip 102, travels up the common anchor 136, across the center cantilever 126, into the top output terminal 122, and through the top CPW 120, where it is routed to the relevant circuitry of the top chip 104. When the switching assembly 100 is in the down-state, a closed circuit is created between the common input terminal 114 and the bottom output terminal 116. Specifically, the contact point 132 of the center cantilever 126 makes contact with the bottom output terminal 116 on the bottom chip 102, such that an RF signal at the common input terminal 114 of the bottom chip 102, travels up the common anchor 136, across the center cantilever 126, into the bottom output terminal 116, and through the bottom CPW 112, where it is routed to the circuitry of the bottom chip 102. Notably, the center cantilever 126 extends further from the torsion member 124 than do the springs 128. As a result, the electrical contacts 132 and 134 on the center cantilever 126 extend past the ends of the springs 128, so that capacitive coupling between the electrically "hot" springs 128 and either of the bottom and top output terminals 116 and 122 is minimized.

It should be noted that the characterization of the terminals as input or output terminals will depend on how the circuit is designed. For example, the common terminal 114 can be an RF output terminal, whereas the bottom and top terminals 116 and 122 can be RF input terminals. In this case, the switching assembly 100 will function in the manner just described, with the exception that the RF signal will travel from one of the selected bottom and top input terminals 116 and 122 to the common output terminal 114.

The flexing of the switching member 106 can be actuated using a variety of means, including magnetic, electrostatic, piezoelectric, shaped memory, and thermal means to name a few. In the illustrated embodiment, magnetic means are used. Specifically, the actuator 108 comprises a magnetic field coil 142, which is affixed to the substrate 118 of the top chip 104, and a plurality of ferrous elements 144, which are affixed along the lengths of both springs 128. The magnetic field coil 142 is composed of a suitable electrically conductive material, such as copper. The top chip 104 further comprises a coil input terminal 146 and coil output terminal 148 (shown in FIGS. 7K and 8K) for providing electrical current to and energizing the coil 142. Supplying the coil 142 with electrical current with opposite polarities selectively places the switching assembly 100 in up and down states. Specifically, when the electrical current has a polarity that induces the magnetic field coil 142 to have a magnetic field that attracts the ferrous elements 144 on the springs 128, the springs 128 accordingly flex upward, thereby placing the cantilever 126 in the up-state. In contrast, when the electrical current has an opposite polarity that induces the magnetic field coil 142 to have a magnetic field that repels the ferrous elements 144 on the springs 128, the springs 128 accordingly flex down, thereby placing the cantilever in the down-state.

Figure 10:
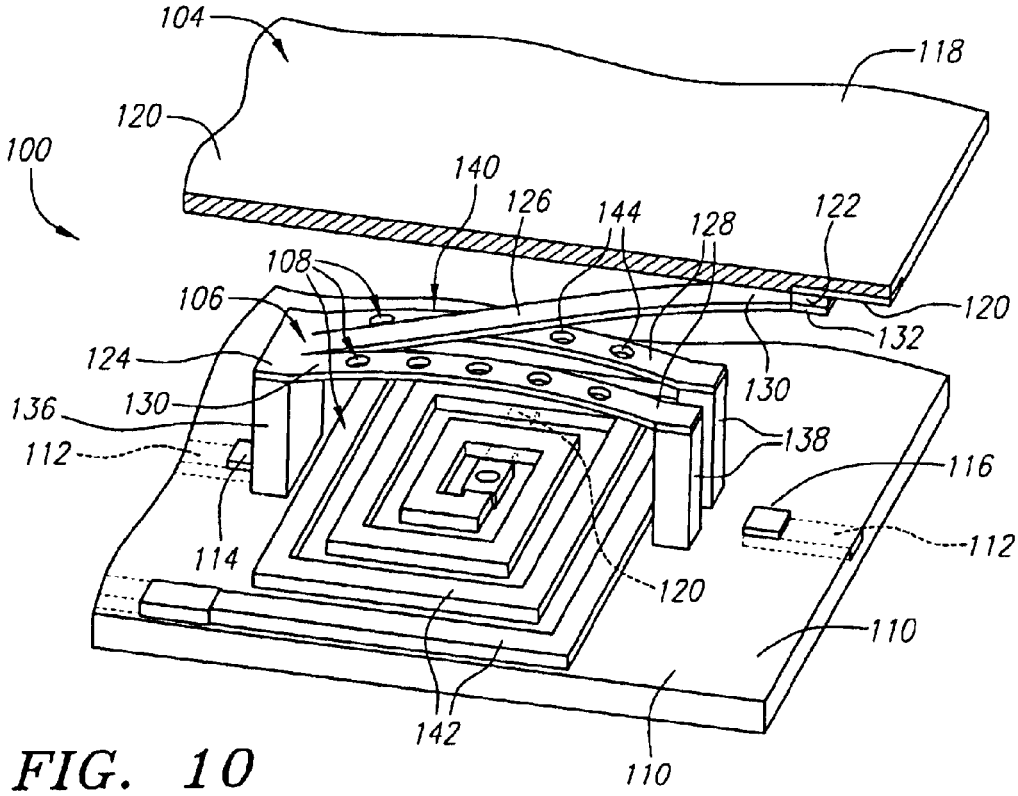
FIG. 10 is a partial cutaway perspective view of the switching assembly of FIG. 1, particularly showing an alternative magnetic actuator arrangement.

In an alternative embodiment, the magnetic field coil 142 is affixed to the substrate 110 of the bottom chip 102, as illustrated in FIG. 10. In this case, the actuator 108 is operated in a similar manner, with the exception that the polarities of the electrical current will be switched to provide the same up and down flexing of the springs 128. In a further alternative embodiment, the magnetic field coil can be printed on the backside of the top substrate 118 and bond wires can be connected to the ends of the coil. In this manner, the coil can be shielded from the CPW to prevent the coil from acting as a "pick-up" coil, which may otherwise cause interference to the RF signals within the CPW. In yet another embodiment, the magnetic field coil fabrication step could be eliminated and the coil could be hand wound around the entire two-chip device after assembly using ordinary copper wire.

Figure 11:
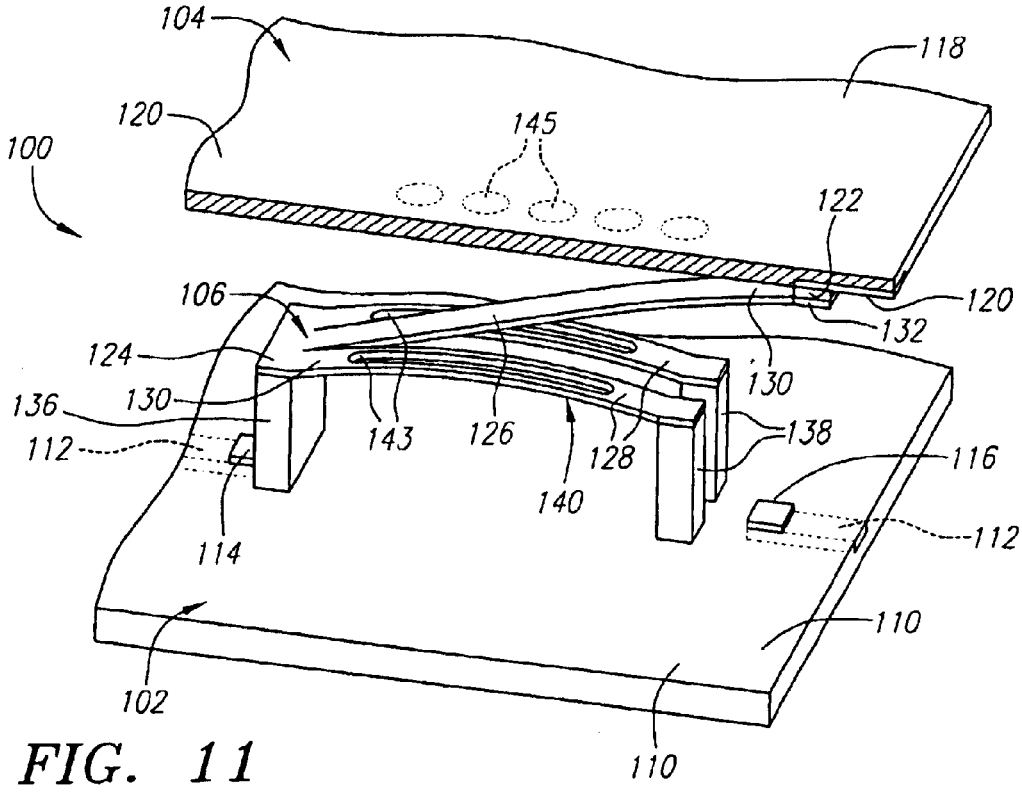
FIG. 11 is a partial cutaway perspective view of the switching assembly of FIG. 1, particularly showing another alternative magnetic actuator arrangement.

In a still further alternative embodiment, ferrous elements 145 are affixed to either of the substrates 110 and 118 of the bottom and top chips 102 and 104, and magnetic field coils 143 are affixed along the lengths of the springs 128, as illustrated in FIG. 11. In this case, the magnetic field coils 143 will be isolated from the electrically conductive springs 128 via a passivation layer (not shown) and will be supplied with electrical current through an electrical path that is isolated from the RF electrical path. Again, flexing of the springs 128 will be actuated by energizing the magnetic field coils with electrical current of opposite polarities.

Turning now to FIGS. 5–9, an exemplary process for fabricating the switching assembly 100 will be described. In general, the bottom chip 102, switching member 106, standoffs (not shown), and ferrous portion of the actuator 108 are monolithically fabricated together by first forming the bottom CPW 112 onto the bottom substrate 110, forming the common input terminal 114 and bottom output terminal 116 onto CPW 112, forming the common anchor 136 onto the common input terminal 114, forming the spring anchors 138 and standoffs onto the substrate 110, and then forming the switching member 106, along with the ferrous elements 144 of the actuator 108, onto the anchors 136 and 138. The top chip 104 and magnetic portion of the actuator 108 are monolithically fabricated together by forming the top CPW 120 and the DC biasing lines (not shown) onto the top substrate 118, forming the top output terminal 122 coil terminals 146 and 148, forming the magnetic field coil 142, and then finally the standoffs (not shown). It should be noted that FIGS. 5–9 are not scale, and are only meant to illustrate the steps contemplated by the exemplary fabrication process. It should also be noted that the fabrication of the standoffs will not be discussed in the following detailed steps. In general, however, the standoffs will be gradually formed on the respective substrates 110 and 118 as each metallic layer in the process is added.

As a preliminary matter, the following lithographic fabrication processes utilize a plurality of patterning layers and masks to pattern and form the various elements of the switching assembly 100. In the illustrated method, photolithography is used to optically expose and polymerize portions of patterning layers through photographic masks. The patterning layers used by the following process can be composed of any suitable photo-sensitive material. In the illustrated process, the patterning layers are composed of photoresist unless otherwise stated. It should be noted, however, that the patterning layers can be patterned using any suitable process, such as selective laser etching, e-beam writing and the like. Photolithography, selective laser etching, and e-beam writing are well known processes in the art of lithography, and will thus not be discussed in further detail. It should also be noted that the following discussion describes the masks as having patterns without reference to positive patterns (i.e., exposed portion of the patterning layer is removed) or negative patterns (i.e., non-exposed portion of the patterning layer is removed). One of ordinary skill in the art, however, will understand that either positive or negative patterns can be used in the following process.

Referring first to FIGS. 5 and 6, the fabrication of the bottom chip 102, along with its associated elements, will be described in detail.

Figure 5A:
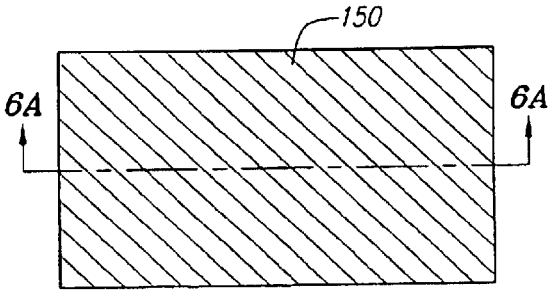
FIG. 5 are plan views of intermediate structures formed during an exemplary process flow for fabricating the bottom chip and associated components of the switching assembly of FIG. 1.
Figure 6A:
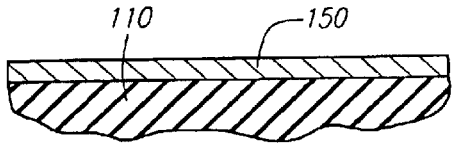
FIG. 6 are cross-sectional views of the corresponding intermediate structures illustrated in FIG. 5.
Figure 5B:
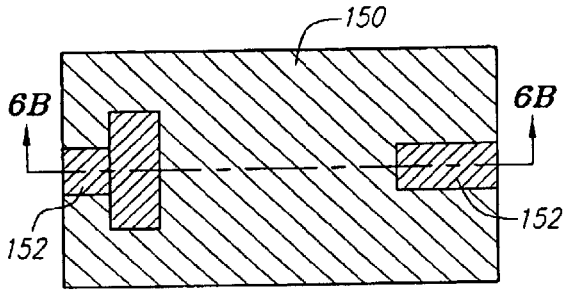
Figure 6B:
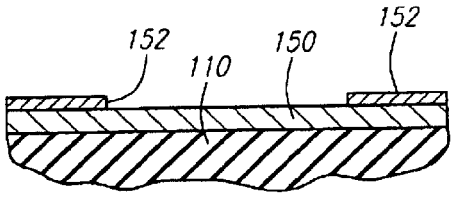
Figure 5C:
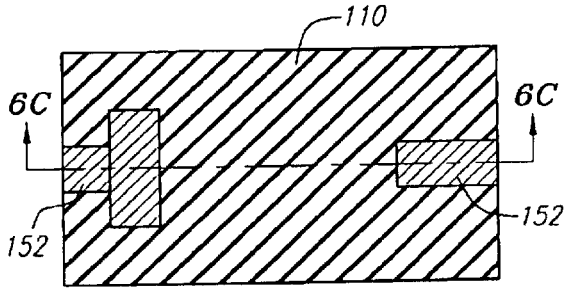
Figure 6C:
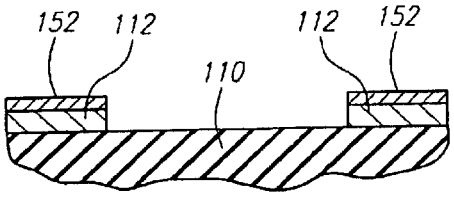
Figure 5D:
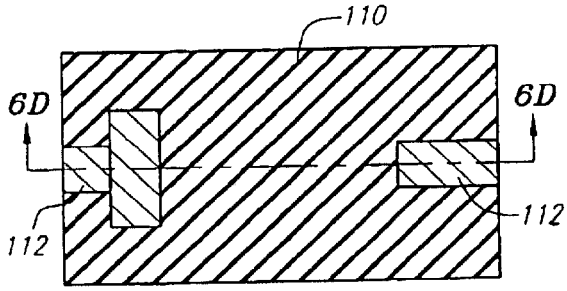
Figure 6D:
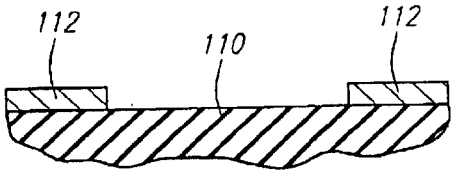

In FIGS. 5A and 6A, the entire surface of the bottom substrate 110 is coated with a gold layer 150 using a standard deposition technique, such as electroplating. This step can either be performed immediately prior to the fabrication process, or can alternatively, be performed by a supplier of such products. In FIGS. 5B and 6B, a CPW patterning layer 152 is deposited over the gold layer 150 and patterned in the shape of the bottom CPW 112. Specifically, the patterning layer 152 is exposed to light through a first mask (not shown) having the desired pattern of the bottom CPW 112, and then the portions of the patterning layer 152 exposed to the light are selectively etched away, thereby transferring the pattern of the mask onto the patterning layer 152. In FIGS. 5C and 6C, the bottom CPW 112 is formed by transferring the pattern of the patterning layer 152 to the gold layer 150 by etching the gold layer 150 with a standard gold etchant, e.g., (42%KI 3%I w/balance in $H_2O$), that selectively etches away the portions of the gold layer 150 exposed by the patterning layer 152. In FIGS. 5D and 6D, the patterning layer 152 is removed from the CPW 112, e.g., using acetone.

Figure 5E:
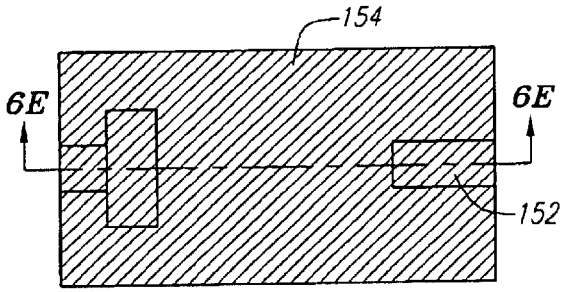
Figure 6E:
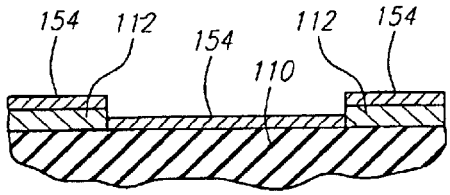
Figure 5F:
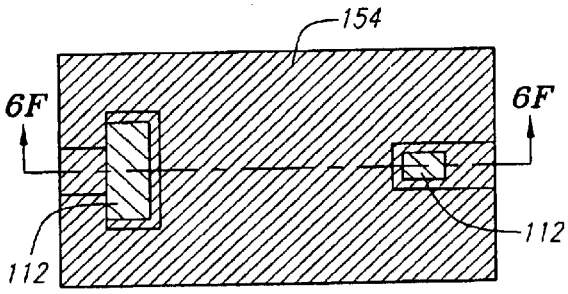
Figure 6F:
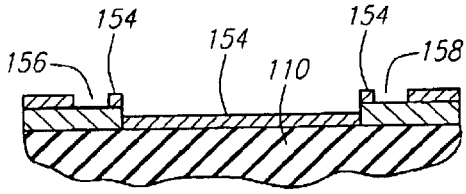
Figure 5G:
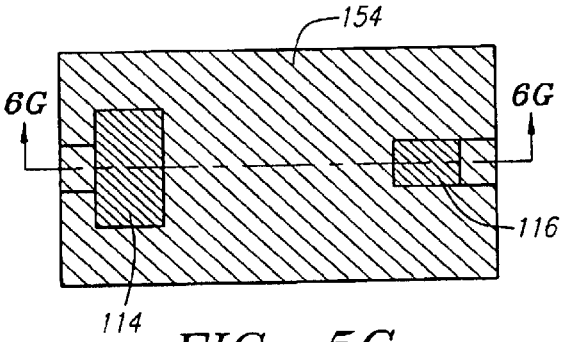
Figure 6G:
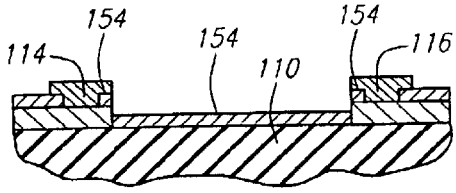

In FIGS. 5E and 6E, to provide electrical isolation between components of the switching assembly 100, as well as protection for the sensitive regions of the switching assembly 100 during handling, a passivation layer 154 is deposited onto the CPW 112 and exposed portions of the substrate 110. In the illustrated embodiment, the passivation layer 154 is composed of a photolithographic material, and specifically, Bisbenzocyclobutene 4022 (BCB), which can be patterned directly using ultraviolet light. In FIGS. 5F and 6F, the passivation layer 154 is patterned to open up terminal vias 156 and 158 to the underlying CPW 112. Specifically, the passivation layer 154 is exposed to UV light through a second mask (not shown) having the desired pattern of the vias 156 and 158, and then the portions of the passivation layer 154 exposed to the UV light are selectively etched away, thereby transferring the pattern of the second mask onto the passivation layer 154. In FIGS. 5G and 6G, hard gold is electroplated within the vias 156 and 158 up through the passivation layer 154 to form the common input terminal 114 and bottom output terminal 116. The hard gold is used in the step, so that the cantilever 126, which is composed of soft gold, does not fuse to the bottom output terminal 116 or otherwise cause stiction problems.

Figure 5H:
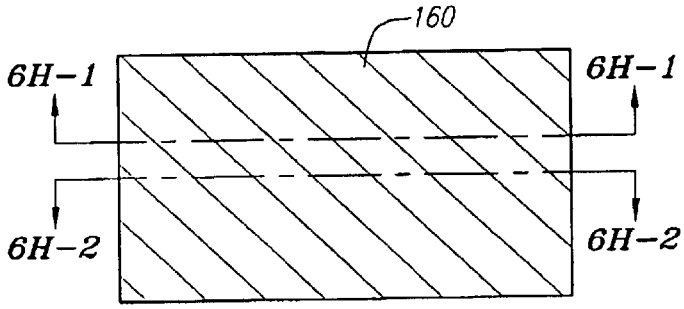
Figures 1, 6H:
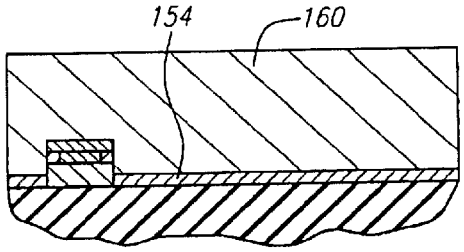
Figures 2, 6H:
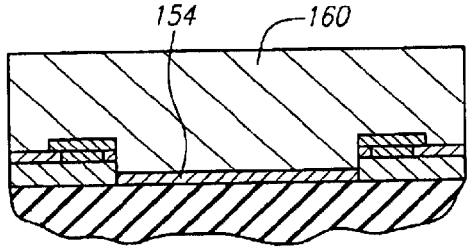
Figure 5I:
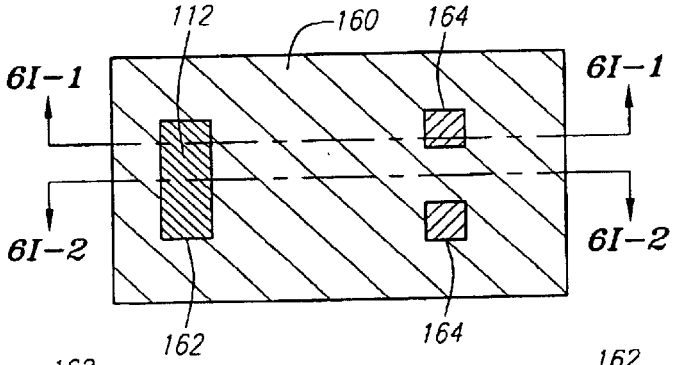
Figures 1, 6I:
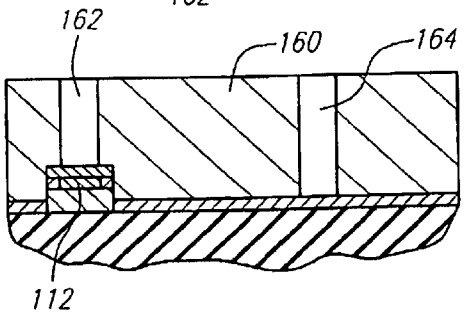
Figures 2, 6I:
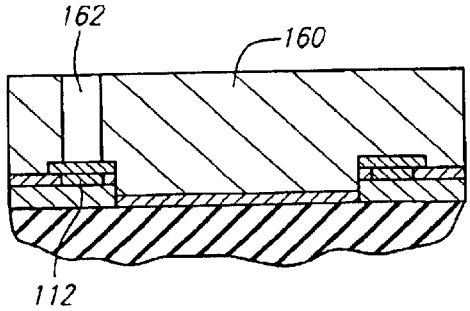
Figure 5J:
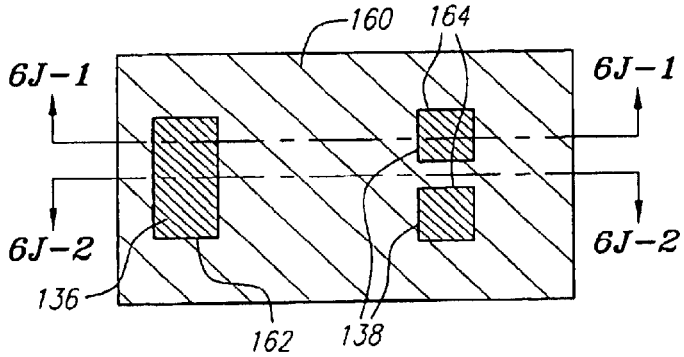
Figures 1, 6J:
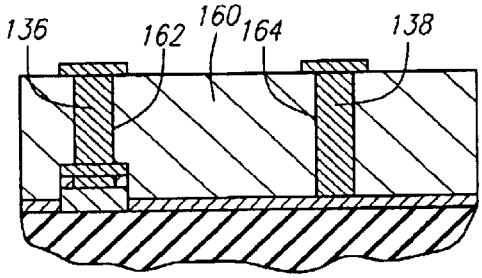
Figures 2, 6J:
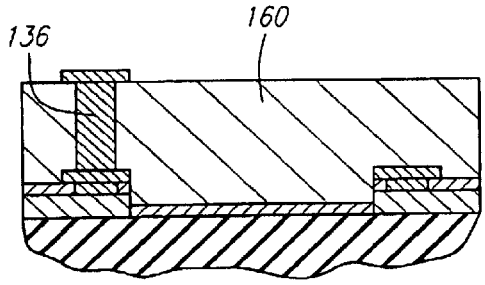
Figure 5K:
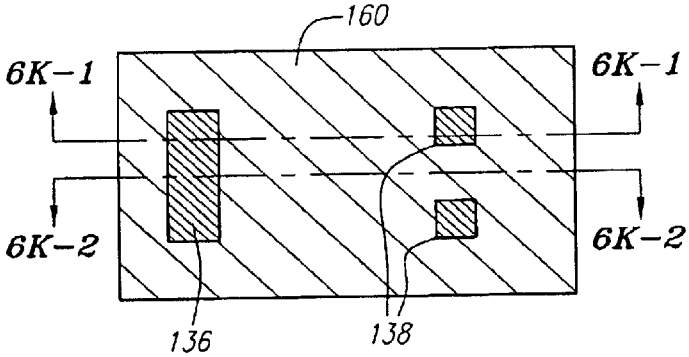
Figures 1, 6K:
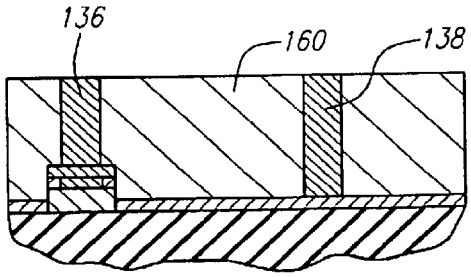
Figures 2, 6K:
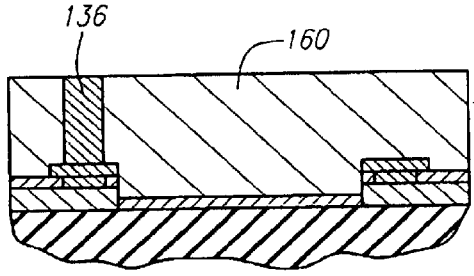

In FIGS. 5H and 6H, to provide mechanical support for the switching member 106 and associated anchors 136 and 138 during fabrication, a sacrificial layer 160 is deposited onto the patterned passivation layer 154. The sacrificial layer 160 may be composed of any suitable material, e.g., thick photoresist or polycarbonate. In the illustrated embodiment, a thick photoresist e.g. SU-8 is used. In FIGS. 5I and 6I, the sacrificial layer 160 is patterned to open up a common anchor via 162 to the underlying common input terminal 114, and spring anchor vias 164 to the passivation layer 154. Specifically, the sacrificial layer 160 is exposed to light by means of a third mask (not shown) having the desired pattern of the vias 162 and 164, and then the portions of the sacrificial layer 156 exposed to the UV light are selectively etched away, thereby transferring the pattern of the third mask onto the sacrificial layer 160. In FIGS. 5J and 6J, hard gold is electroplated within the vias 162 and 164 up through the sacrificial layer 156 to form the common and spring anchors 136 and 138. At this stage in the process, the tops of the anchors 136 and 138, and the top surface of the sacrificial layer 160 will generally be rough, which is undesirable since this surface will later define the bottom surface of the switching member 106. In order to obtain a smoother bottom surface for the switching member 106, the tops of the anchors 136 and 138 and the top surface of the sacrificial layer 160 are planarized using a reflow process or a chemical mechanical polishing step, causing the top surface of the sacrificial layer 160 to smooth out, as illustrated in FIGS. 5K and 6K. This is done to ensure the springs 128 have a preferred bending mode corresponding to the first mode shape of the doubly clamped beam, i.e. a "guitar string" mode. Otherwise, there is a risk that the springs 128 will assume an undesirable "S" shape (second mode) or worse.

Figure 5L:
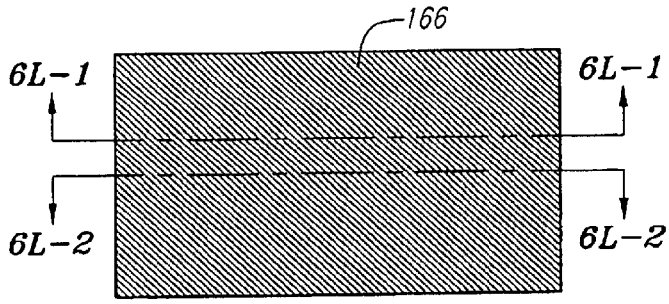
Figures 1, 6L:
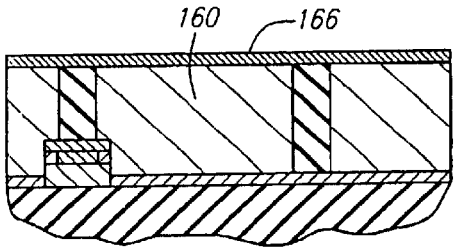
Figures 2, 6L:
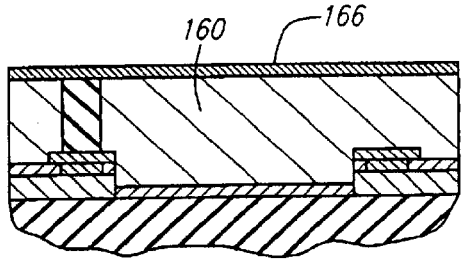
Figure 5M:
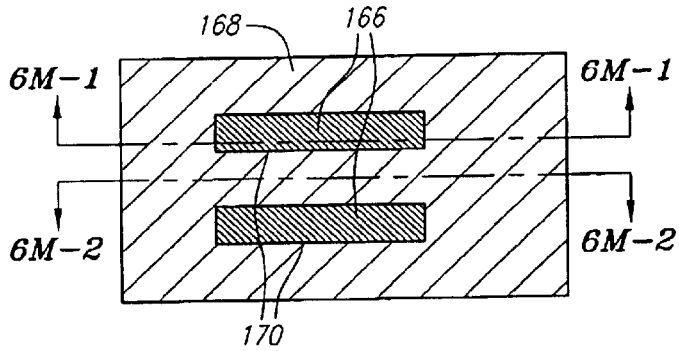
Figures 1, 6M:
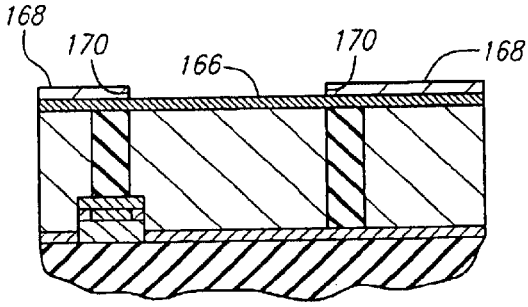
Figures 2, 6M:
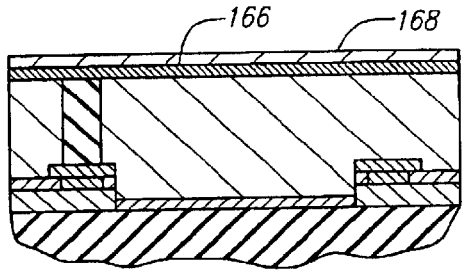
Figure 5N:
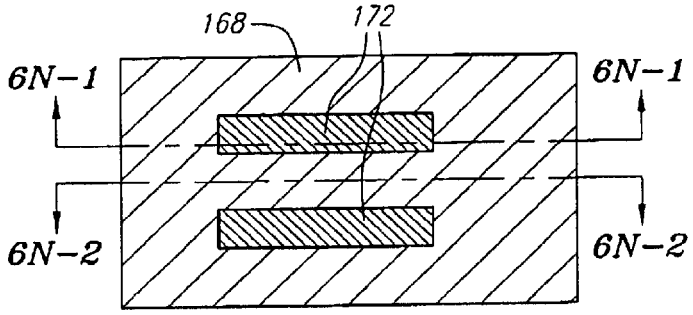
Figures 1, 6N:
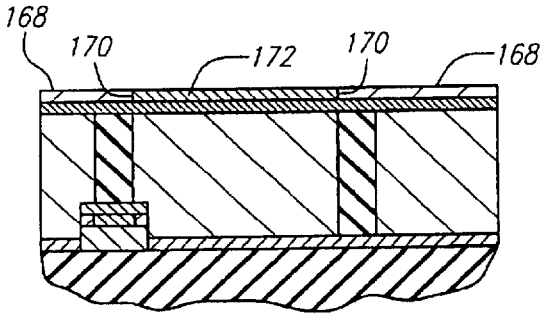
Figures 2, 6N:
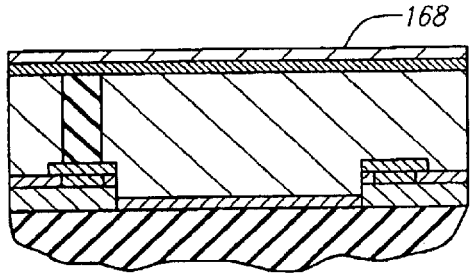
Figure 50:
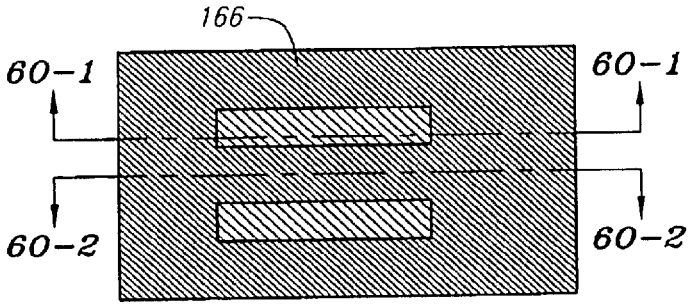
Figures 1, 60:
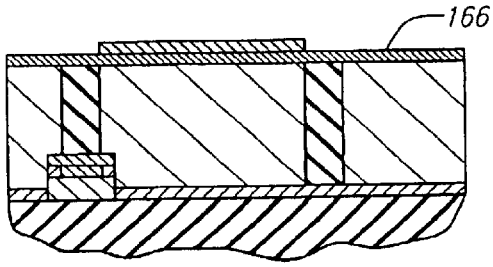
Figures 2, 60:
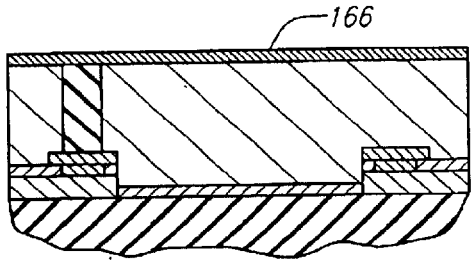
Figure 5P:
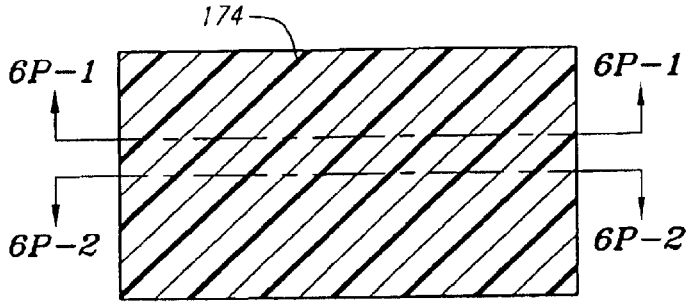
Figures 1, 6P:
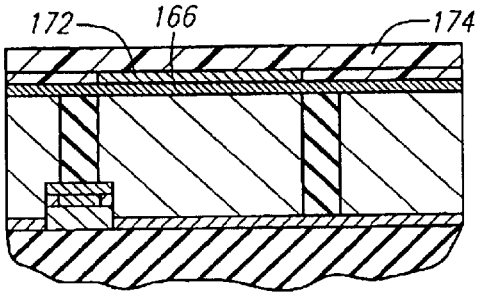
Figures 2, 6P:
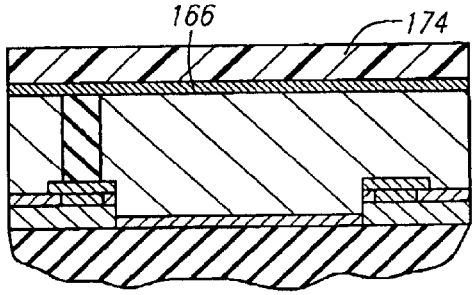

In FIGS. 5L and 6L, a seed layer 166 is deposited onto the sacrificial layer 160 via a suitable process, such as, e.g., evaporation. The seed layer 166 is composed of a material that is electrically conductive, and has a high affinity to the metal ions in the electroplating solution, e.g., gold, titanium and/or tungsten. In FIGS. 5M and 6M, a spring patterning layer 168 is deposited over the seed layer 166 and patterned to form a mold 170 for the curvature-inducing layer of the springs 128 of the switching member 106. Specifically, the patterning layer 168 is exposed to light through a fourth mask (not shown) having the desired pattern of the springs 128 of the switching member 106, and then the portions of the patterning layer 168 exposed to the light are selectively etching away, thereby transferring the pattern of the mask onto the patterning layer 168. In FIGS. 5N and 6N, a thin layer of hard gold 172 (in the illustrated embodiment, approximately 1 $\mu$m, but in general, is preferably roughly 10% of the total thickness of the later deposited soft gold) is selectively electroplated within spring mold 170, i.e., the etched portions of the patterning layer 168. As will be described in further detail below, this thin gold layer 172 will be used to provide the springs 128 with an inherent stress gradient, so that they exhibit the desired curvature. Further details on the introduction of a stress gradient within members are disclosed in copending U.S. patent application Ser. No. 09/944,867, entitled "Electrostatic Actuators with Intrinsic Stress Gradient," which is expressly incorporated herein by reference. In the illustrated process, the ends of the springs 128 adjacent the anchors 138 will not include the gold layer 172, since they will be anchored and thus will not exhibit any curvature. In FIGS. 5O and 6O, the patterning layer 168 is removed from the seed layer 166, e.g., using acetone. In FIGS. 5P and 6P, a thick layer of soft gold 174 (e.g., 10 $\mu$m) is deposited (e.g., by electroplating) over the thin gold layer 172 that forms one layer of the springs 128, as well as the exposed portions of the seed layer 166, to form the main structure of the switching member 106.

Figure 5Q:
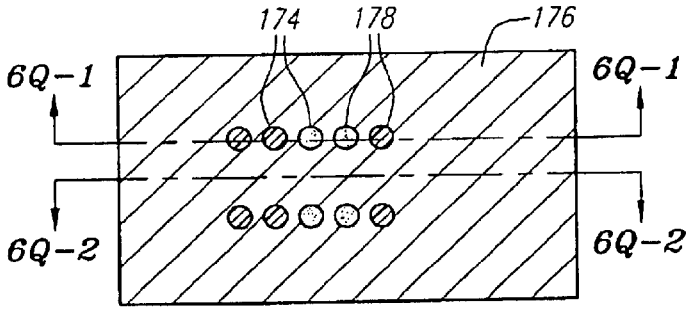
Figures 1, 6Q:
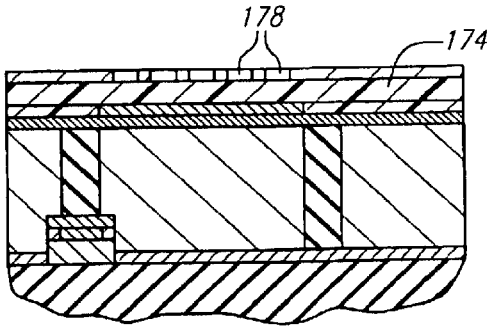
Figures 2, 6Q:
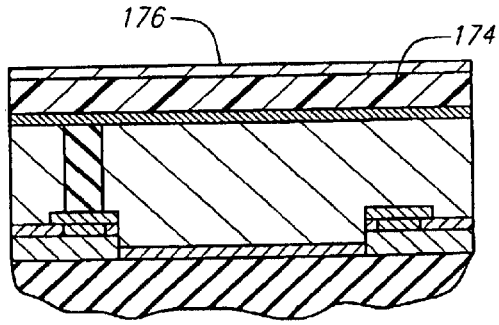
Figure 5R:
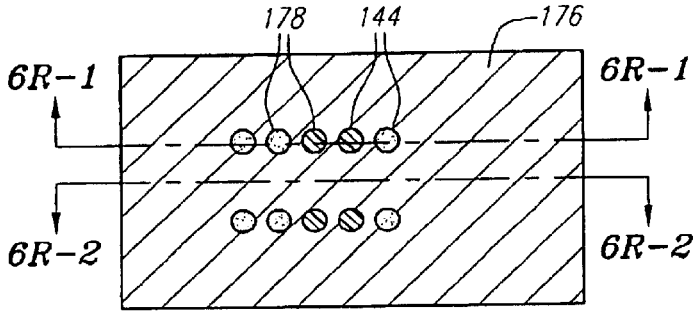
Figures 1, 6R:
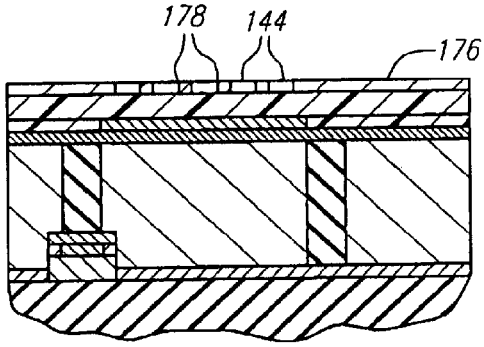
Figures 2, 6R:
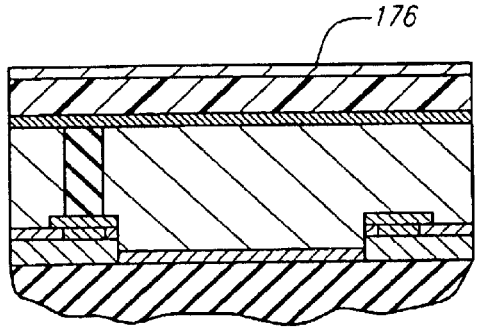
Figure 5S:
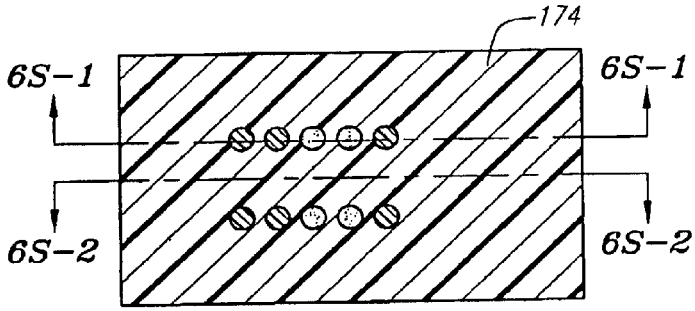
Figures 1, 6S:
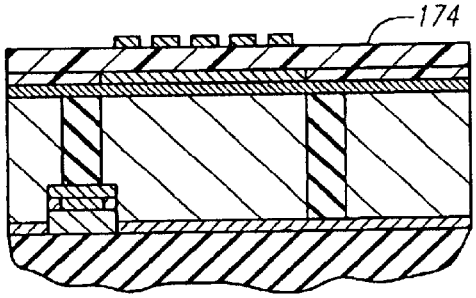
Figures 2, 6S:
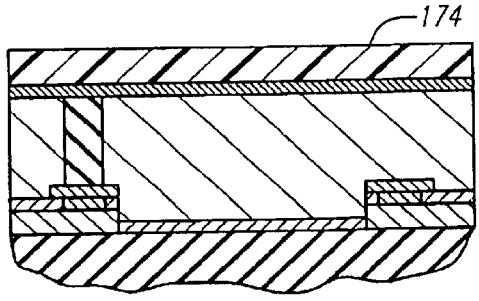

In FIGS. 5Q and 6Q, a ferrous element patterning layer 176 is deposited over the soft gold layer 174 and patterned only over the springs 128 to form a mold 178 for the ferrous elements 144 of the actuator 108. Specifically, the patterning layer 176 is exposed to light through a fifth mask (not shown) having the desired pattern of the ferrous elements 144, and then the portions of the patterning layer 176 exposed to the light are selectively etched away, thereby transferring the pattern of the mask onto the patterning layer 176. In FIGS. 5R and 6R, a ferrous material is selectively electroplated within the ferrous element mold 178, i.e., the etched portions of the patterning layer 176, to form the ferrous elements 144. In FIGS. 5S and 6S, the patterning layer 176 is removed from the soft gold layer 174, e.g., using acetone.

Figure 5T:
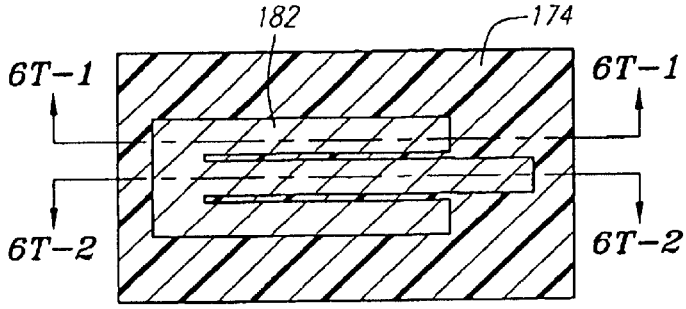
Figures 1, 6T:
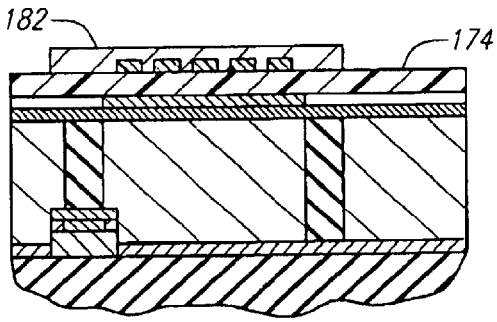
Figures 2, 6T:
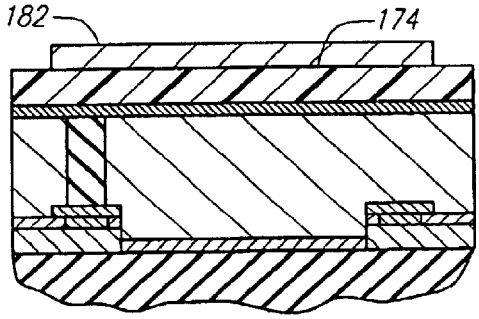
Figure 5U:
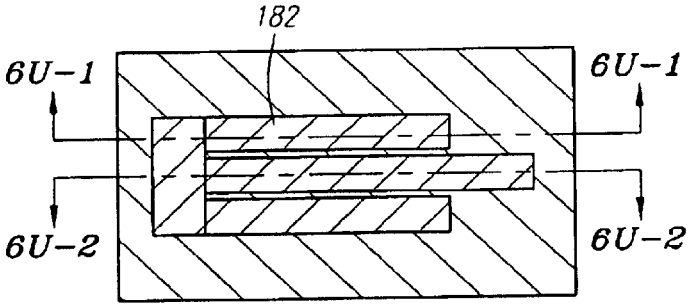
Figures 1, 6U:
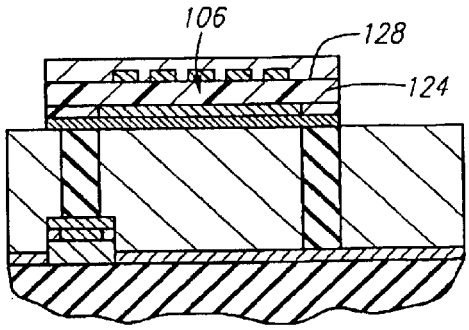
Figures 2, 6U:
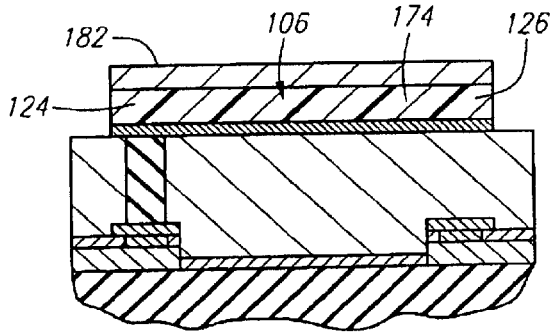
Figure 5V:
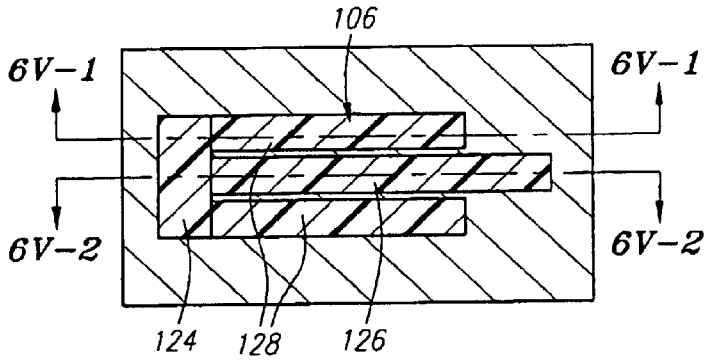
Figures 1, 6V:
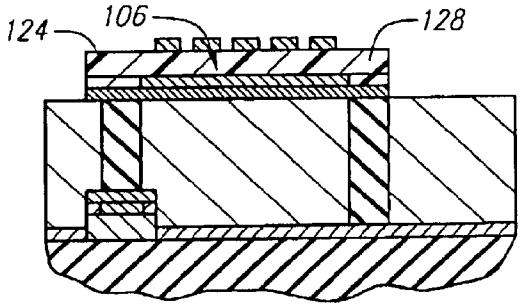
Figures 2, 6V:
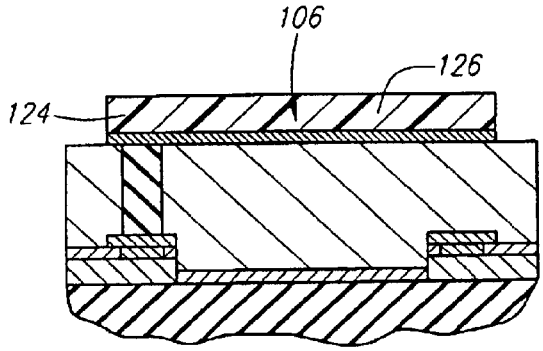

In FIGS. 5T and 6T, a switching member patterning layer 182 is deposited over the soft gold layer 174 and patterned in the shape of the switching member 106. Specifically, the patterning layer 182 is exposed to light through a sixth mask (not shown) having the desired pattern of switching member 106, and then the portions of the patterning layer 182 exposed to the light are selectively etched away, thereby transferring the pattern of the mask onto the patterning layer 182. In FIGS. 5U and 6U, the switching member 106, with the transverse torsion member 124, center cantilever 126, and springs 128, is formed by transferring the pattern of the patterning layer 182 to the soft gold layer 174 by etching the gold layer 174 with a standard gold etchant that selectively etches away the portions of the gold layer 174 exposed by the patterning layer 182. In FIGS. 5V and 6V, the patterning layer 182 is removed from the switching member 106, e.g., using acetone.

Figure 5W:
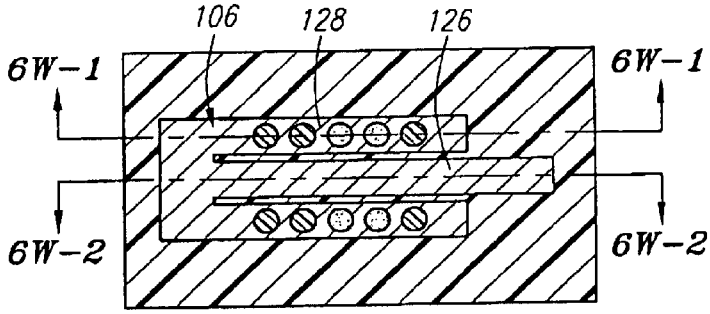
Figures 1, 6W:
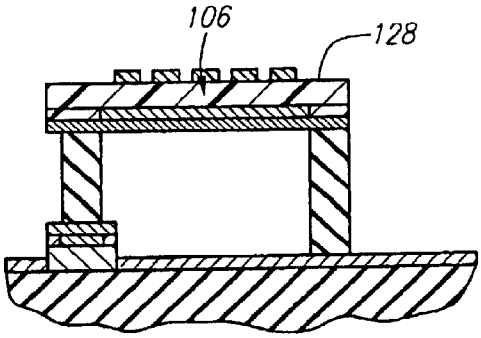
Figures 2, 6W:
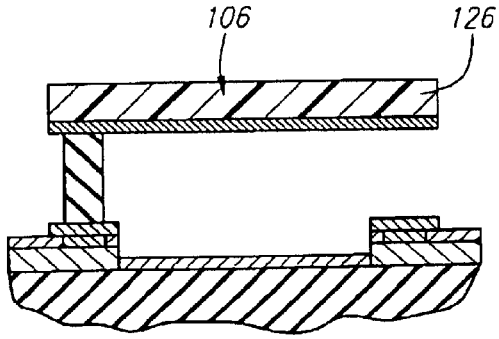

In FIGS. 5W and 6W, the sacrificial layer 160 is removed to release the switching member 106. The sacrificial layer 160 may be removed using suitable means, e.g., thick resist stripper to dissolve the sacrificial layer 160 followed by a rinse with a liquid agent, e.g., deionized (DI) water or methanol, or by an appropriate dry etch using plasma, or thermal decomposition in the case of a polycarbonate release layer.

Referring now to FIG. 7, the fabrication of the top chip 102, along with its associated elements, will be described in detail.

Figure 7A:
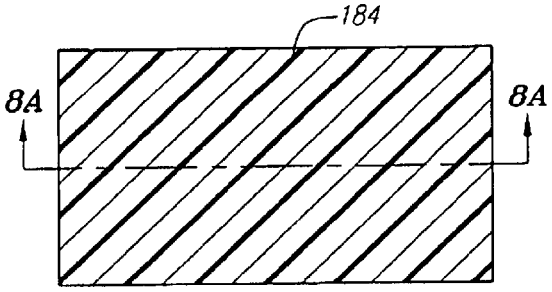
FIG. 7 are plan views of intermediate structures formed during an exemplary process flow for fabricating the top chip and associated components of the switching assembly of FIG. 1.
Figure 8A:
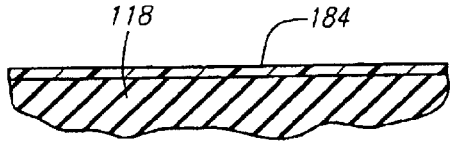
FIG. 8 are cross-sectional views of the corresponding intermediate structures illustrated in FIG. 7.
Figure 7B:
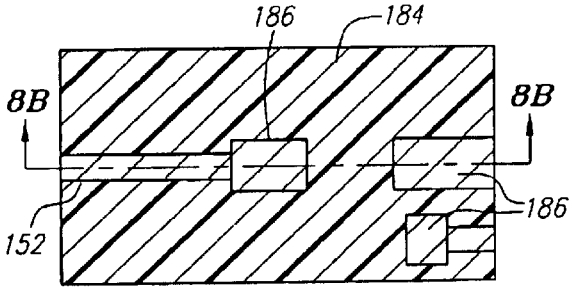
Figure 8B:
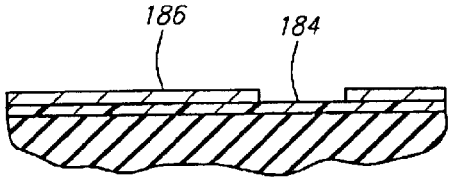
Figure 7C:
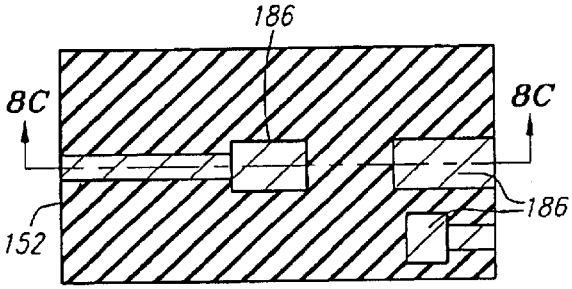
Figure 8C:
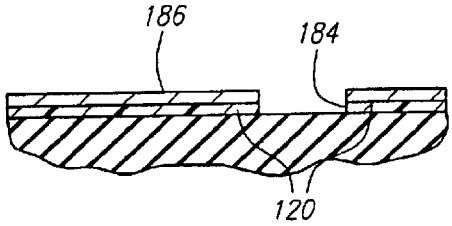
Figure 7D:
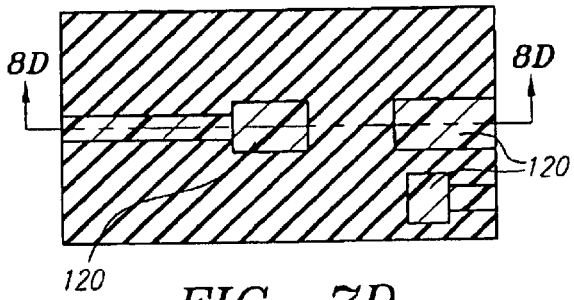
Figure 8D:
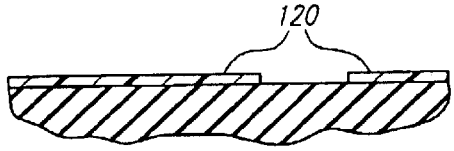

In FIGS. 7A and 8A, the entire surface of the top substrate 118 is coated with a gold layer 184 using a standard deposition technique, such as electroplating. This step can either be performed immediately prior to the fabrication process, or can alternatively, be performed by a supplier of such products. In FIGS. 7A and 7B, a CPW patterning layer 186, which in the illustrated embodiment is composed of photoresist material, is deposited over the gold layer 184 and patterned in the shape of the top CPW 120. Specifically, the patterning layer 186 is exposed to light through a seventh mask (not shown) having the desired pattern of the top CPW 120, and then the portions of the patterning layer 186 exposed to the light are selectively etched away, thereby transferring the pattern of the mask onto the patterning layer 186. In FIG. 7C, the top CPW 120 is formed by transferring the pattern of the patterning layer 186 to the gold layer 184 by etching the gold layer 184 with a standard gold etchant that selectively etches away the portions of the gold layer 184 exposed by the patterning layer 186. In FIG. 7D, the patterning layer 186 is removed from the CPW 120, e.g., using acetone.

Figure 7E:
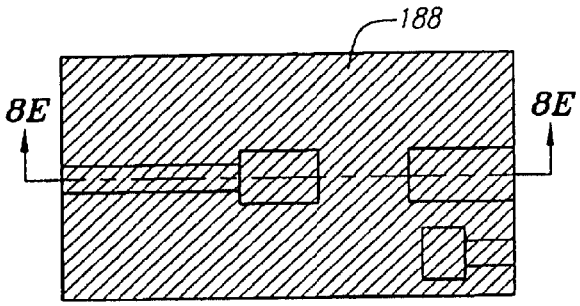
Figure 8E:
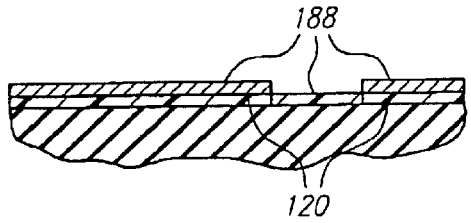
Figure 7F:
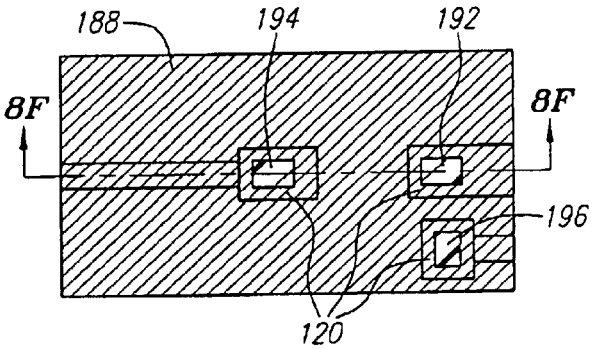
Figure 8F:
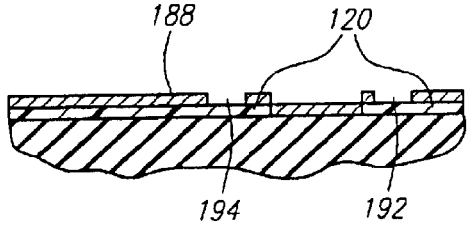
Figure 7G:
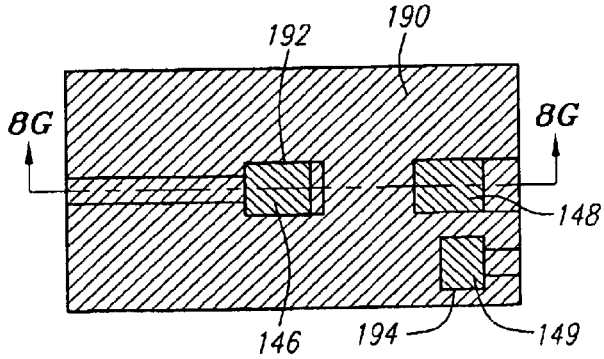
Figure 8G:
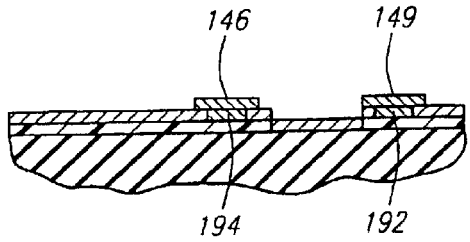

In FIGS. 7E and 8E, to provide electrical isolation between components of the switching assembly 100, as well as protection for the sensitive regions of the switching assembly 100 during handling, a passivation layer 188 is deposited onto the CPW 120 and exposed portions of the substrate 118. In the illustrated embodiment, the passivation layer 188 is composed of a photolithographic material, and specifically BCB. In FIGS. 7F and 8F, the passivation layer 188 is patterned to open up terminal vias 190, 192, and 194 to the underlying CPW 120. Specifically, the passivation layer 188 is exposed to UV light through an eighth mask (not shown) having the desired pattern of the vias 190, 192, and 194, and then the portions of the passivation layer 188 exposed to the UV light are selectively etched away, thereby transferring the pattern of the eighth mask onto the passivation layer 188. In FIGS. 7G and 8G, a suitable electrically conductive material, such as hard gold, is electroplated within the vias 190, 192, and 194 up through the passivation layer 188 to form a spacing terminal 149 for the top output terminal 122 and coil terminals 146 and 148.

Figure 7H:
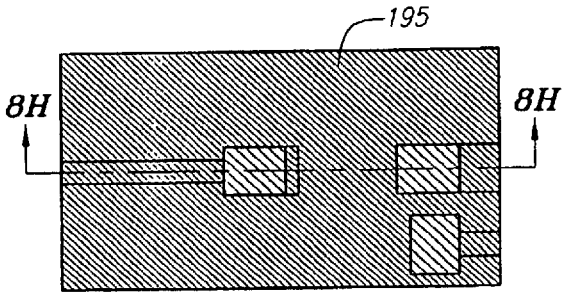
Figure 8H:
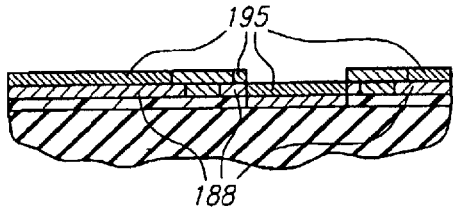
Figure 7I:
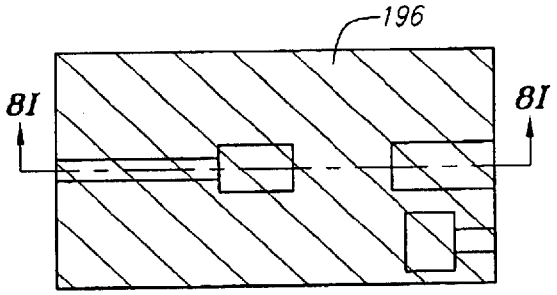
Figure 8I:
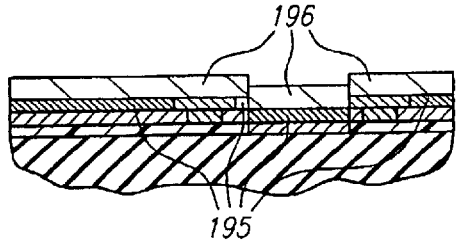
Figure 7J:
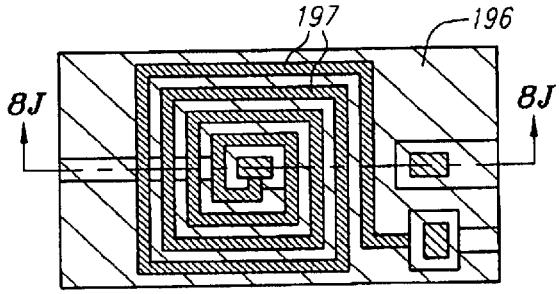
Figure 8J:
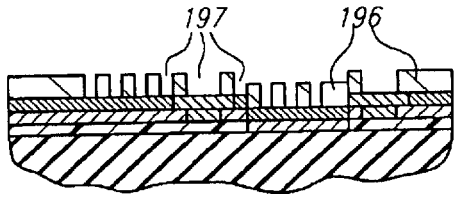
Figure 7K:
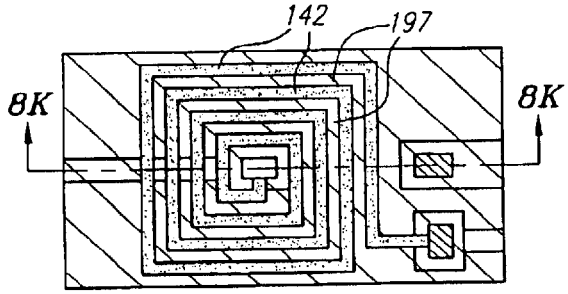
Figure 8K:
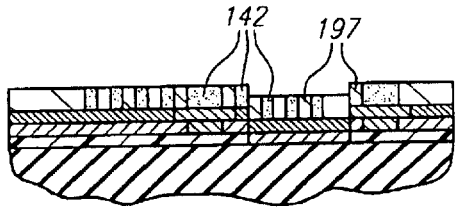
Figure 7L:
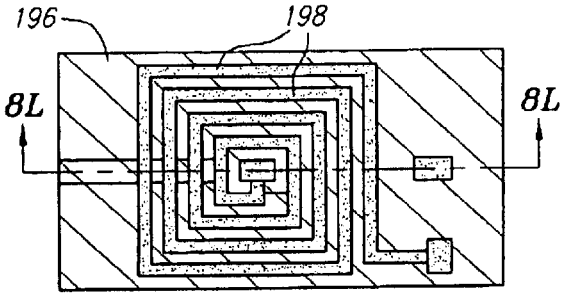
Figure 8L:
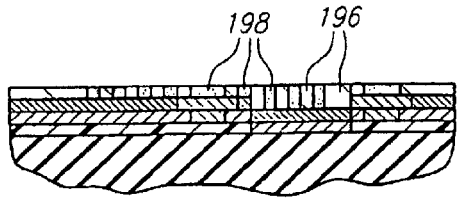

In FIGS. 7H and 8H, a seed layer 195 is deposited onto the passivation layer 188 via a suitable process, such as, e.g., evaporation. The seed layer 195 is composed of a material that is electrically conductive, and has a high affinity to the metal ions in the electroplating solution, e.g., gold, titanium and/or tungsten. In FIGS. 7I and 8I, a coil patterning layer 196, which in the illustrated embodiment is composed of a thick photoresist e.g. SU-8, is deposited over the seed layer 195. In FIGS. 7J and 8J, the patterning layer 196 is patterned to create a coil mold 197. Specifically, the patterning layer 196 is exposed to light through a ninth mask (not shown) having the desired pattern of the magnetic actuator coil 142, and then the portions of the patterning layer 196 exposed to the light are selectively etching away, thereby transferring the pattern of the mask onto the patterning layer 196. In FIGS. 7K and 8K, coil material, such as copper, is electroplated within coil mold 197 to form the coil 142. In FIGS. 7L and 8L, the top of the coil 142 and the top surface of the patterning layer 196 are planarized using a suitable process, such as chemical mechanical polishing.

Figure 7M:
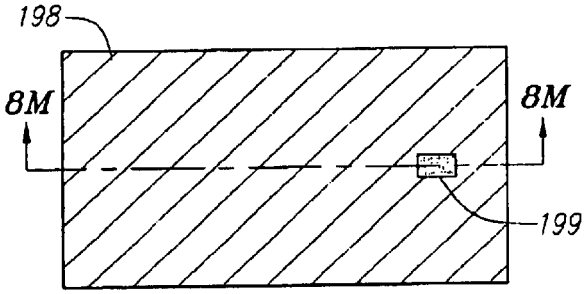
Figure 8M:
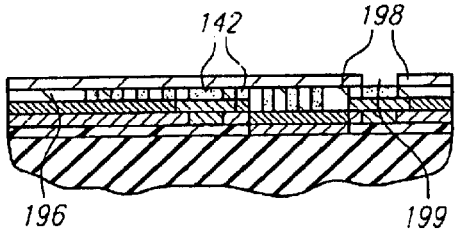
Figure 7N:
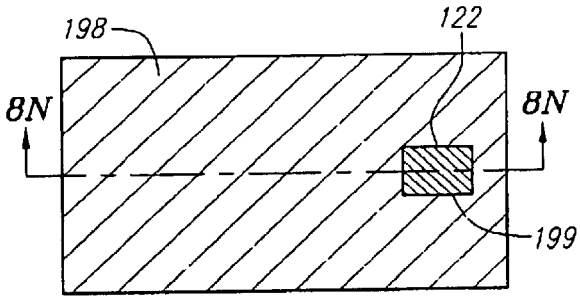
Figure 8N:
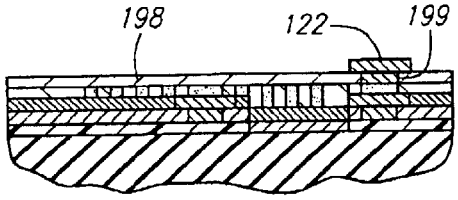
Figure 70:
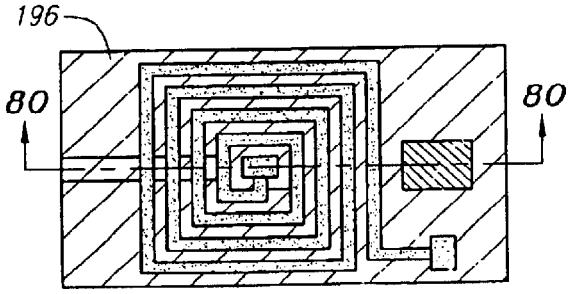
Figure 80:
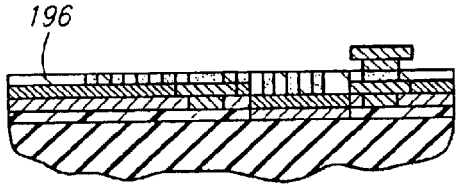

In FIGS. 7M and 8M, a terminal patterning layer 198 is deposited over the coil patterning layer 196 and coil 142, and patterned to create a via 199 for the top output terminal 122. Specifically, the patterning layer 198 is exposed to light through a tenth mask (not shown) having the desired pattern of the via 199, and then portions of the passivation layer 188 exposed to the light are selectively etched away, thereby transferring the pattern of the tenth mask onto the patterning layer 198. In FIGS. 7N and 8N, hard gold is electroplated within the via 199 up through the patterning layer 198 to form the top output terminal 122. The hard gold is used in this step, so that the cantilever 126, which is composed of soft gold, does not fuse to the top output terminal 122 or otherwise cause stiction problems. Next, an eleventh thick photoresist mask (not shown) is used to expose the standoffs (not shown), and then a thick layer of soft gold and a thin layer of indium or other suitable soldering metal (not shown) is deposited by appropriate deposition process, e.g. evaporation or sputtering. This will bring the standoff height equal to that of the standoff on the opposite chip, and act as the adhesion layer between the upper and lower chips. In FIGS. 7O and 8O, the extraneous indium, the indium patterning layer and the terminal patterning layer 198 are removed from the coil patterning layer 196, e.g., using acetone. In FIGS. 7P and 8P, the coil patterning layer 196 is removed from the seed layer 195, e.g., by appropriate stripper, plasma etch, or thermal decomposition, thereby dissolving the patterning layer 196 followed by a rinse with a liquid agent, e.g., deionized (DI) water or methanol. In FIGS. 7Q and 8Q, the seed layer 195 is etched away from the passivation layer 188 with a standard gold etchant that selectively etches away the exposed portions of the seed layer 195.

Once the bottom and top chips 102 and 104 are fabricated, the switching assembly 100 is assembled by mounting the chips 102 and 104 relative to each other, as illustrated in FIG. 9. The distance between the chips 102 and 104 is determined by the height of the standoffs, such that when the switching assembly 100 is in the up-state, the free end 130 of the cantilever 126 makes contact with the top output terminal 122 (FIG. 1), and when the switching assembly 100 is in the down-state, the free end 130 of the cantilever 126 makes contact with the bottom output terminal 116 (FIG. 2). Once the two chips are properly aligned, a low temperature eutectic bond is formed using the indium layer or other such soft solder-like material between the gold standoffs on the upper and lower chips.

Figure 12:
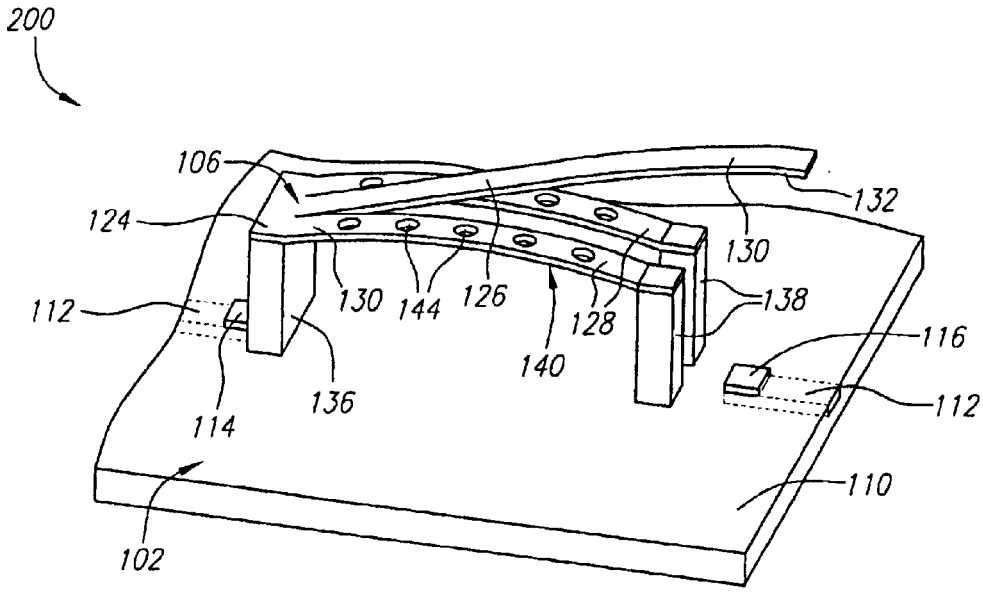
FIG. 12 is a single pole single throw MEMS RF switching assembly constructed in accordance with another preferred embodiment of the present inventions, wherein the switching assembly is particularly shown in an up-state.
Figure 13:
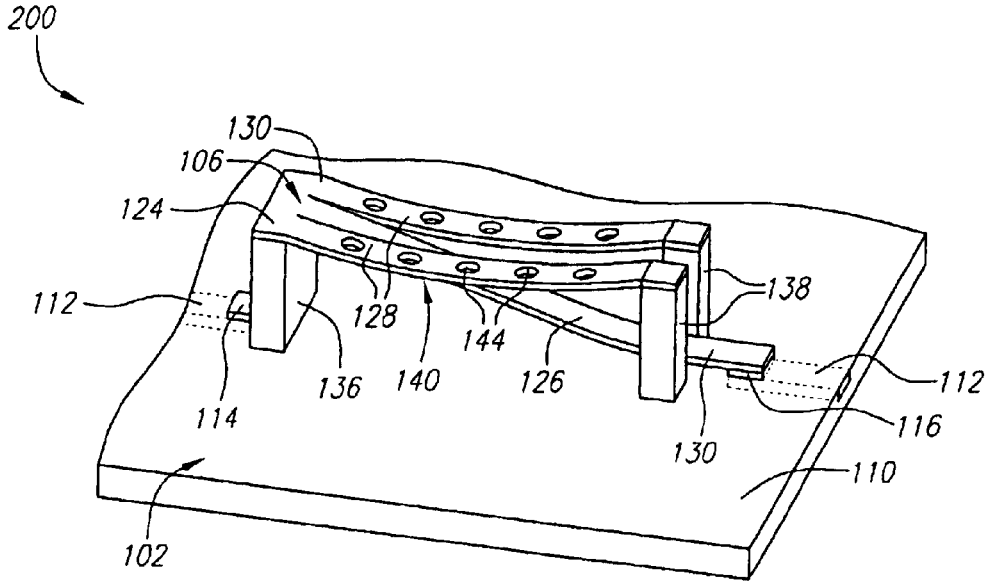
FIG. 13 is a partial cutaway perspective of the switching assembly of FIG. 12, wherein the switching assembly is particularly shown in a down-state.

Although the above-discussed switching assembly 100 has described as a SPDT switch, the switching member 106 can be advantageously used with other types of bi-stable switches. For example, FIGS. 12 and 13 show a single pole single throw (SPST) switching assembly 200 constructed in accordance with another preferred embodiment of the present inventions. That switching assembly 200 is structurally similar to the switching assembly 100, with the exception that it does not utilize a top chip, and thus, the top RF output terminal, in the switching scheme. In this case, the magnetic field coil 142 is affixed to an adjacent structure, or alternative affixed to the bottom chip 102 (as shown in FIG. 10).

Functionally, rather than alternately switching an RF signal from a common input terminal to one of two output terminals, the switching assembly 200 alternately switches between an on-state, where an RF signal is conveyed from an input terminal to a single output terminal, or an off-state, where the RF signal is not conveyed from the input terminal at all.

Thus, it can be appreciated that when the switching assembly 200 is in the down-state (or "on-state") (FIG. 13), a closed circuit is created between the input and output terminals 114 and 116. Specifically, the contact point 132 of the center cantilever 126 makes contact with the output terminal 116 on the bottom chip 102, such that an RF signal at the input terminal 114 of the bottom chip 102, travels up the common anchor 136, across the center cantilever 126, into the output terminal 116, and through the bottom CPW 112, where it is routed to the circuitry of the bottom chip 102. When the switching assembly 200 is in the up-state (or "off-state") (FIG. 12), however, an open circuit is created between the input and output terminals 114 and 116. Specifically, the contact point 132 of the center cantilever 126 is taken out of contact with the output terminal 116, and thus, the RF signal from the input terminal 114 does not travel to the output terminal 116.

As previously mentioned, the characterization of the terminals as input or output terminals will depend on how the circuit is designed. For example, the terminal 114 can be an RF output terminal, whereas the terminal 116 can be a RF input terminal. In this case, the switching assembly 200 will function in the manner just described, with the exception that the RF signal will travel from the input terminal 116 to the output terminal 114 when the switching assembly 200 is placed in the on-state.

The switching assembly 200 can be fabricated in a similar manner as the switching assembly 100, with the exception that only the bottom chip 102 and its associated components, which now includes the magnetic field coil 142, will be monolithically fabricated onto the bottom chip 102.

Figure 14:
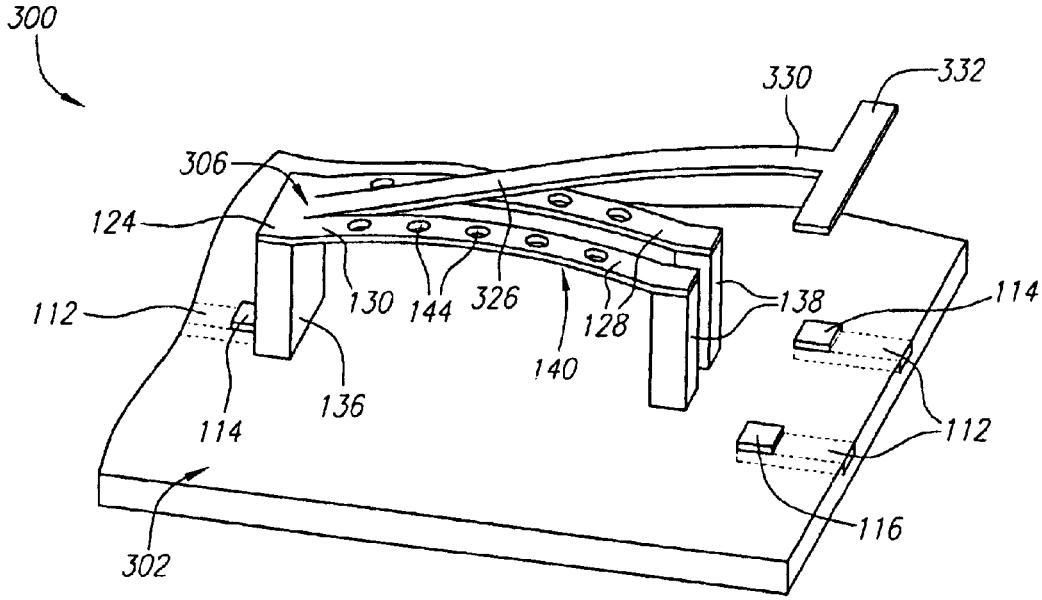
FIG. 14 is another single pole single throw MEMS RF switching assembly constructed in accordance with still another preferred embodiment of the present inventions, wherein the switching assembly is particularly shown in an up-state.
Figure 15:
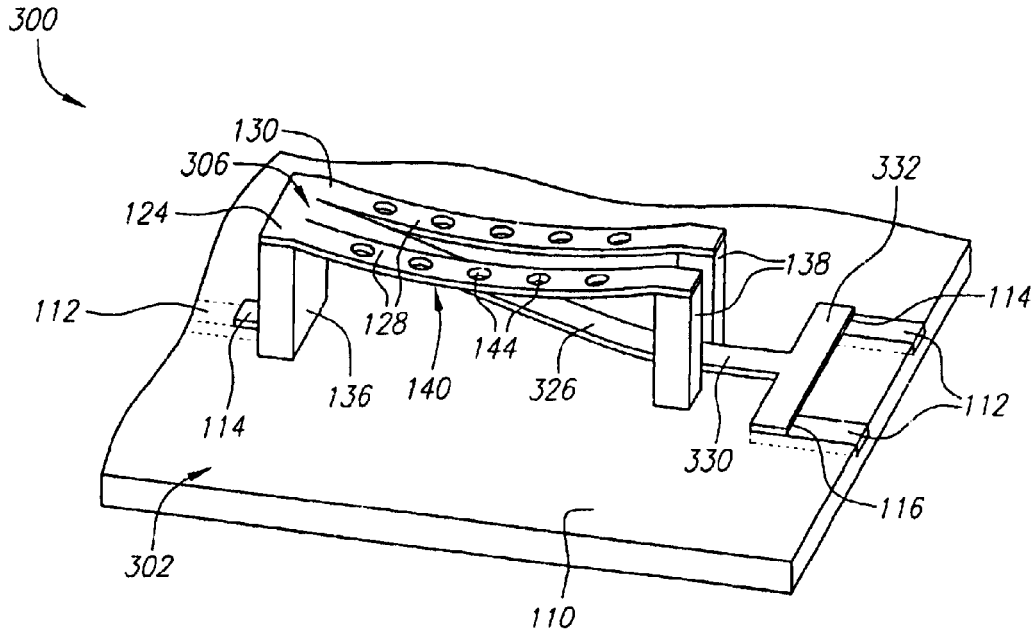
FIG. 15 is a partial cutaway perspective of the switching assembly of FIG. 14, wherein the switching assembly is particularly shown in a down-state.

FIGS. 14 and 15 show another SPST switching assembly 300 constructed in accordance with another preferred embodiment of the present inventions. That switching assembly 300 is structurally similar to the switching assembly 200, with the exception that the RF input and output terminals are adjacent each other and the center cantilever is modified to short these input and output terminals. To this end, the switching assembly 300 comprises a bottom chip 302 that includes RF input and output terminals 114 and 116 that are disposed on one side of the substrate 110 adjacent each other. The switching assembly 300 further comprises a switching member 306 that is similar to the previously described switching member 106, with the exception that it comprises a center cantilever 326 that includes a transverse shorting bar 332 at its free end 330. The shorting bar 332 is centered on the free end 330 of the cantilever 326 and has a length that is at least equal to the spacing between the input and output terminals 114 and 116.

Thus, it can be appreciated that when the switching assembly 300 is in the down-state (or "on-state") (FIG. 15), a closed circuit is created between the input and output terminals 114 and 116. Specifically, the shorting bar 332 of the center cantilever 326 makes contact with the input and output terminals 114 and 116, such that an RF signal at the input terminal 114 travels across the shorting bar 332 and into the output terminal 116. When the switching assembly 200 is in the up-state (or "off-state") (FIG. 14), however, an open circuit is created between the input and output terminals 114 and 116. Specifically, the shorting bar 332 of the center cantilever 126 is taken out of contact with the input and output terminals 114 and 116, and thus, the RF signal from the input terminal 114 does not travel to the output terminal 116.

As previously mentioned, the characterization of the terminals as input or output terminals will depend on how the circuit is designed. For example, the terminal 114 can be an RF output terminal, whereas the terminal 116 can be a RF input terminal. In this case, the switching assembly 300 will function in the manner just described, with the exception that the RF signal will travel from the input terminal 116 to the output terminal 114 when the switching assembly 300 is placed in the on-state.

The switching assembly 200 can be fabricated in a similar manner as the switching assembly 200, with the exception that input and output terminals 114 and 116 are fabricated adjacent each other. Also, because the common anchor 136 need not be electrically conductive, or at the least need not be connected to the CPW 112, the common anchor 136 can be formed directly onto the passivation layer with the spring anchors 138 (see FIG. 6K-1). Also, with the exception of the shorting bar 332, the switching member 106 can be composed of a non-electrically conductive material, or at least an electrically conductive material that is not as conductive as gold, e.g., a polymer. In this manner, the any RF interference that would otherwise be generated by an electrically conductive switching member will be eliminated.

Although particular embodiments of the present inventions have been shown and described, it will be understood that it is not intended to limit the present inventions to the preferred embodiments, and it will be obvious to those skilled in the art that various changes and modifications may be made without departing from the spirit and scope of the present inventions. Thus, the present inventions are intended to cover alternatives, modifications, and equivalents, which may be included within the spirit and scope of the present inventions as defined by the claims.

What is claimed is:

1. A micro-electro-mechanical system (MEMS) switching assembly, comprising:

a stable structure;

a switching member including a transverse torsion member having a flexible portion, a leaf spring, and an electrically conductive cantilever having a free end, the leaf spring and cantilever extending from the flexible portion of the torsion member;

a first anchoring member mounting the torsion member to the stable structure; and a second anchoring member mounting the leaf spring to the stable structure, wherein the leaf spring has a flexible portion between the first and second anchoring members that can be alternately flexed in opposing directions to deflect the cantilever end in the respective opposing directions.

2. The switching assembly of claim 1, wherein the stable structure comprises a substrate.

3. The switching assembly of claim 1, wherein the resilient switching member comprises a planar membrane.

4. The switching assembly of claim 1, wherein the cantilever is electrically conductive.

5. The switching assembly of claim 1, wherein the switching member comprises another leaf spring extending from the flexible portion of the torsion member, the first and second leaf springs straddling the cantilever.

6. The switching assembly of claim 1, wherein the leaf spring extends from the flexible portion of the torsion member a first distance, and the cantilever extends from the flexible portion of the torsion member a second distance greater than the first distance.

7. The switching assembly of claim 1, wherein the cantilever end deflects a first distance when the leaf spring flexes a second distance, the first distance being greater than the second distance.

8. The switching assembly of claim 7, wherein the first distance is more than twice as great as the second distance.

9. The switching assembly of claim 1, wherein the leaf spring exhibits a first stable geometry when flexed in one of the opposite directions, and exhibits a second stable geometry when flexed in another of the opposite directions.

10. The switching assembly of claim 9, wherein the leaf spring has a stress gradient that maintains the leaf spring in the first and second stable geometries.

11. The switching assembly of claim 9, wherein the first stable geometry is a convex geometry and the second stable geometry is a concave geometry.

12. The switching assembly of claim 1, further comprising:

a common electrical terminal permanently electrically coupled to the cantilever;

a first electrical terminal electrically coupled to the cantilever only when the cantilever is deflected in one of the opposite directions; and a second electrical terminal electrically coupled to the cantilever only when the cantilever is deflected in another of the opposite directions.

13. The switching assembly of claim 12, wherein the first anchoring member is electrically conductive and is mounted to the common electrical terminal.

14. The switching assembly of claim 1, further comprising:

a first electrical terminal permanently electrically coupled to the cantilever; and a second electrical terminal electrically coupled to the cantilever only when the cantilever is deflected in one of the opposite directions.

15. The switching assembly of claim 14, wherein the first anchoring member is electrically conductive and is mounted to the first electrical terminal.

16. The switching assembly of claim 1, further comprising first and second electrical terminals electrically coupled to the cantilever only when the cantilever is deflected in one of the opposite directions.

17. The switching assembly of claim 16, wherein the cantilever comprises a shorting bar that shorts the first and second electrical terminals when the cantilever is deflected in the one opposite direction.

18. The switching assembly of claim 1, further comprising an actuator operatively coupled to the leaf spring to alternately flex the leaf spring in the opposing first and second directions.

19. The switching assembly of claim 18, wherein the actuator is a magnetic actuator.

20. The switching assembly of claim 19, wherein the actuator comprises:

a magnetic field coil affixed to the leaf spring; and one or more ferrous elements placed a distance from the magnetic field coil, such that the leaf spring is flexed towards the one or more ferrous elements when electrical current with a first polarity flows through the magnetic field coil, and is flexed away from the one or more ferrous elements when electrical current with a second polarity flows through the magnetic field coil.

21. The switching assembly of claim 19, wherein the actuator comprises:

one or more ferrous elements affixed to the leaf spring; and a magnetic field coil placed a distance from the magnetic field coil, such that the leaf spring is flexed towards the one or more ferrous elements when electrical current with a first polarity flows through the magnetic field coil, and is flexed away from the one or more ferrous 5 elements when electrical current with a second polarity flows through the magnetic field coil.

22. A micro-electro-mechanical system (MEMS) switching assembly, comprising:

a first substrate having a common terminal and a first terminal;

a second substrate having a second terminal;

a resilient switching member including a transverse torsion member having a flexible portion, a leaf spring, and an electrically conductive cantilever having a free end, the leaf spring and cantilever extending from the flexible portion of the torsion member;

a first anchoring member mounting the torsion member to the stable structure; and a second anchoring member mounting the leaf spring to the stable structure, wherein the leaf spring has a flexible portion between the first and second anchoring members that can be alternately flexed in opposing directions to alternately deflect the cantilever end into electrical conduction with the first and second terminals.

23. The switching assembly of claim 22, wherein the switching member comprises a planar membrane.

24. The switching assembly of claim 22, wherein the cantilever is electrically conductive.

25. The switching assembly of claim 22, wherein the switching member comprises another leaf spring extending from the flexible portion of the torsion member, the first and second leaf springs straddling the cantilever.

26. The switching assembly of claim 22, wherein the leaf spring extends from the flexible portion of the torsion member a first distance, and the cantilever extends from the flexible portion of the torsion member a second distance greater than the first distance.

27. The switching assembly of claim 22, wherein the cantilever end deflects a first distance when the leaf spring flexes a second distance, the first distance being greater than the second distance.

28. The switching assembly of claim 27, wherein the first distance is more than twice as great as the second distance.

29. The switching assembly of claim 22, wherein the leaf spring exhibits a first stable geometry when flexed in one of the opposite directions, and exhibits a second stable geometry when flexed in another of the opposite directions.

30. The switching assembly of claim 29, wherein the leaf spring has a stress gradient that maintains the leaf spring in the first and second stable geometries.

31. The switching assembly of claim 29, wherein the first stable geometry is a convex geometry and the second stable geometry is a concave geometry.

32. The switching assembly of claim 22, wherein the first anchoring member is electrically conductive and is mounted to the common terminal.

33. The switching assembly of claim 22, further comprising an actuator operatively coupled to the leaf spring to alternately flex the leaf spring in the opposing first and second directions.

34. The switching assembly of claim 33, wherein the actuator is a magnetic actuator.

35. The switching assembly of claim 34, wherein the actuator comprises:

a magnetic field coil affixed to the leaf spring; and one or more ferrous elements affixed to one of the first and second substrates, such that the leaf spring is flexed towards the one or more ferrous elements when electrical current with a first polarity flows through the magnetic field coil, and is flexed away from the one or more ferrous elements when electrical current with a second polarity flows through the magnetic field coil.

36. The switching assembly of claim 34, wherein the actuator comprises:

one or more ferrous elements affixed to the leaf spring; and a magnetic field coil affixed to one of the first and second substrates, such that the leaf spring is flexed towards the one or more ferrous elements when electrical current with a first polarity flows through the magnetic field coil, and is flexed away from the one or more ferrous elements when electrical current with a second polarity flows through the magnetic field coil.

37. The switching assembly of claim 22, wherein first substrate comprises a coplanar waveguide coupled to the common input terminal and first terminal, and the second substrate comprises a coplanar waveguide coupled to the second terminal.

38. A switching member for a micro-electro-mechanical system (MEMS) switch assembly, comprising:

a transverse torsion member having a flexible portion;

an electrically conductive cantilever extending from the flexible portion of the torsion member, the cantilever having a free end; and a pair of leaf springs extending from the flexible portion of the torsion member, the leaf springs straddling the cantilever, the pair of leaf springs alternately exhibiting stable first and second geometries when flexed in opposite directions to deflect the cantilever end in the respective opposing directions.

39. The switching member of claim 38, wherein the cantilever is electrically conductive.

40. The switching member of claim 38, wherein the pair of leaf springs extend from the flexible portion of the torsion member a first distance, and the cantilever extends from the flexible portion of the torsion member a second distance greater than the first distance.

41. The switching member of claim 38, wherein the cantilever end deflects a first distance when the leaf spring flexes a second distance, the first distance being greater than the second distance.

42. The switching member of claim 41, wherein the first distance is more than twice 10 as great as the second distance.

43. The switching member of claim 38, wherein the pair of leaf springs has a stress gradient that maintains the pair of leaf springs in the stable convex and concave geometries.

44. The switching member of claim 38, wherein the first stable geometry is a convex geometry, and the second stable geometry is a concave geometry.

45. A micro-electro-mechanical system (MEMS) switching assembly comprising:

a substrate;

a resilient switching member mounted to the substrate, the resilient switching member moveable between a first, flexed stable geometry and a second, flexed stable geometry, the switching member including a cantilever, the cantilever being electrically coupled to a first electrical terminal;

an actuator for moving the resilient switching member between the first, flexed stable geometry and the second, flexed stable geometry; and a second electrical terminal, the second electrical terminal being electrically coupled to the cantilever when the resilient switching member is in the first, flexed stable geometry and not electrically coupled the cantilever when the resilient switching member is in the second, flexed stable geometry.

46. The micro-electro-mechanical system (MEMS) switching assembly of claim 45, wherein the actuator comprises a magnetic actuator.

47. The micro-electro-mechanical system (MEMS) switching assembly of claim 46, the magnetic actuator comprises a magnetic field coil.

48. The micro-electro-mechanical system (MEMS) switching assembly of claim 47, wherein the magnetic field coil is disposed on the substrate.

49. The micro-electro-mechanical system (MEMS) switching assembly of claim 47, wherein the magnetic field coil is disposed on a second substrate, the second substrate facing the first substrate.

50. The micro-electro-mechanical system (MEMS) switching assembly of claim 45, wherein the second electrical terminal is disposed on the substrate.

51. The micro-electro-mechanical system (MEMS) switching assembly of claim 45, wherein the second electrical terminal is disposed on a second substrate, the second substrate facing the first substrate.

52. The micro-electro-mechanical system (MEMS) switching assembly of claim 45, further comprising a third electrical terminal, the third electrical terminal being electrically coupled to the cantilever when the resilient switching member is in the second, flexed stable geometry and not electrically coupled the cantilever when the resilient switching member is in the first, flexed stable geometry.

53. The micro-electro-mechanical system (MEMS) switching assembly of claim 52, wherein the second electrical terminal is disposed on a second substrate, the second substrate facing the first substrate.

54. The micro-electro-mechanical system (MEMS) switching assembly of claim 45, wherein the actuator moves the resilient switching member between the first, flexed stable geometry and the second, flexed stable geometry by using a momentary force.

55. The micro-electro-mechanical system (MEMS) switching assembly of claim 45, wherein the actuator is quiescent when the resilient switching member is stable in the first, flexed stable geometry and the second, flexed stable geometry.

* * * * *